US012446702B1

(12) United States Patent
Gibbons et al.

(10) Patent No.: US 12,446,702 B1
(45) Date of Patent: Oct. 21, 2025

(54) FIRM SUPPORT PILLOW

(71) Applicant: The Boppy Company, LLC, Golden, CO (US)

(72) Inventors: Haley Gibbons, Westminster, CO (US); Sarah Lynne Gallegos, Lakewood, CO (US)

(73) Assignee: The Boppy Company, LLC, Golden, CO (US)

( * ) Notice: Subject to any disclaimer, the term of this patent is extended or adjusted under 35 U.S.C. 154(b) by 0 days.

(21) Appl. No.: 18/795,725

(22) Filed: Aug. 6, 2024

(51) Int. Cl.
*A47C 20/02* (2006.01)
*A47D 13/08* (2006.01)
*A47G 9/10* (2006.01)

(52) U.S. Cl.
CPC ..... *A47C 20/02* (2013.01); *A47D 13/083* (2013.01); *A47G 9/1063* (2013.01); *A47G 9/1072* (2013.01); *A47G 9/109* (2013.01)

(58) Field of Classification Search
CPC ..... A47D 13/083; A47G 9/10; A47G 9/1072; A47G 9/109; A47G 9/1063; A47G 9/1018; A47C 20/02; A47C 20/025
USPC ... 5/655, 632, 490, 652, 636, 640, 657, 633, 5/645, 630, 637, 644, 648, 690, 718; D6/601
See application file for complete search history.

(56) References Cited

U.S. PATENT DOCUMENTS 1,787,832 A 1/1931 Mueller
4,066,072 A 1/1978 Cummins
4,165,125 A 8/1979 Owen
4,321,718 A 3/1982 Chern
4,731,890 A 3/1988 Roberts
(Continued)

FOREIGN PATENT DOCUMENTS

DE 20 2014 004 891 U1 7/2015
KR 20190037667 A * 4/2019
(Continued)

OTHER PUBLICATIONS

Bbhugme Nursing Pillow Kit product description, retrieved from www.bbhugme.com/pages/product-care, accessed on Jan. 8, 2021, 6 pages.
(Continued)

*Primary Examiner* — Justin C Mikowski
*Assistant Examiner* — Deborah Talitha Gedeon
(74) *Attorney, Agent, or Firm* — Kilpatrick Townsend & Stockton LLP

(57) ABSTRACT

A support pillow includes a pillow body with a substantially straight medial region, a substantially straight first arm extending from the substantially straight medial region and a first free end. The pillow body further includes a substantially straight second arm extending from the substantially straight medial region and a second free end. A distance between the first free end and the second free end is at least 8 inches. The substantially straight first arm, the substantially straight medial region, and the substantially straight second arm define an outer periphery and an inner periphery. The inner periphery defines a curved support cavity. The support pillow includes a fabric shell enclosing an amount of a fill material and includes a first piece, a second piece, and a gusset connected to the first piece and the second piece that extends around the inner periphery and the outer periphery.

15 Claims, 13 Drawing Sheets

(56) References Cited

U.S. PATENT DOCUMENTS 4,862,535 A 9/1989 Roberts
4,895,327 A 1/1990 Malone et al.
4,916,765 A 4/1990 Castronovo, Jr.
D309,068 S 7/1990 Jordan et al.
4,980,937 A 1/1991 Mason et al.
D315,845 S 4/1991 Lafley
D318,202 S 7/1991 Weber
5,029,351 A 7/1991 Weber
D318,969 S 8/1991 Byrn
5,086,529 A 2/1992 DeGroot
5,092,005 A 3/1992 Byrn
5,095,567 A 3/1992 Kenoyer
5,109,557 A 5/1992 Koy et al.
5,133,085 A 7/1992 de Pasquale Amicarelli et al.
5,133,098 A 7/1992 Weber
5,154,649 A 10/1992 Pender
5,193,238 A 3/1993 Clute
5,239,717 A 8/1993 Sue
5,261,133 A 11/1993 Wilkerson
5,261,134 A 11/1993 Matthews
5,272,780 A 12/1993 Clute
5,357,642 A 10/1994 Clute
5,367,730 A 11/1994 Sher
D353,494 S 12/1994 Beger
D369,054 S 4/1996 Straub et al.
D369,934 S 5/1996 Straub et al.
5,519,906 A 5/1996 Fanto-Chan
5,522,104 A 6/1996 Little
5,534,014 A 7/1996 Demeritt et al.
5,535,468 A 7/1996 Mallernee
5,546,620 A 8/1996 Matthews
5,551,108 A 9/1996 Butler, III
5,551,109 A 9/1996 Tingley et al.
5,581,833 A 12/1996 Zenoff
5,661,861 A 9/1997 Matthews
5,664,828 A 9/1997 Simon
5,675,852 A 10/1997 Watkins
5,675,853 A 10/1997 Linge
D389,359 S 1/1998 Nowak
5,709,000 A 1/1998 Hansen et al.
5,715,535 A 2/1998 Hamilton et al.
5,790,999 A 8/1998 Clark
5,826,287 A 10/1998 Tandrup
D408,676 S 4/1999 Straub et al.
5,930,854 A 8/1999 O'Neill et al.
5,937,461 A 8/1999 Dombrowski et al.
D413,751 S 9/1999 Alyea
5,947,427 A 9/1999 Holmquist
6,000,761 A 12/1999 Rocha
6,038,720 A 3/2000 Matthews et al.
6,055,657 A 4/2000 Heo et al.
6,055,687 A 5/2000 Matthews
6,061,854 A 5/2000 Crowley
6,079,067 A 6/2000 Becker et al.
6,112,748 A 9/2000 Esdale et al.
6,119,873 A 9/2000 Matthews
D432,846 S 10/2000 Parker et al.
6,189,169 B1 2/2001 Marcotte
6,230,348 B1 5/2001 Patrikakis
D443,461 S 6/2001 Hall et al.
D444,981 S 7/2001 Hall et al.
6,279,185 B1 8/2001 Matthews
D450,516 S 11/2001 Darling et al.
D450,517 S 11/2001 Darling et al.
6,321,403 B1 11/2001 Matthews
6,354,665 B1 3/2002 Ross
6,381,786 B1 5/2002 Cadden
6,381,787 B1 5/2002 Rogone et al.
6,412,128 B1 7/2002 Matthews
6,434,770 B2 8/2002 Matthews Brown
6,453,493 B1 9/2002 Matthews Brown
6,484,337 B1 11/2002 Moe et al.
6,499,165 B1 12/2002 Morgillo
6,523,200 B2 2/2003 Brown
6,523,793 B1 2/2003 Higgins
6,532,612 B2 3/2003 Matthews Brown
6,536,057 B2 3/2003 Fennell et al.
6,539,567 B1 4/2003 Bae
6,553,590 B1 4/2003 Leach
D474,059 S 5/2003 Cartwright
6,564,408 B2 5/2003 Van Vuuren
6,574,810 B2 6/2003 Mangiaracina
6,625,828 B2 9/2003 Matthews Brown
6,640,977 B2 11/2003 Matthews Brown et al.
6,651,282 B1 11/2003 Skoug et al.
D483,978 S 12/2003 Smith
6,658,681 B2 12/2003 Britto et al.
6,671,908 B2 1/2004 Brown et al.
6,685,024 B1 2/2004 Matthews
6,708,354 B1 3/2004 Carter et al.
6,711,770 B1 3/2004 Owens et al.
6,745,399 B1 6/2004 Austin
6,754,924 B1 6/2004 Brady et al.
6,763,539 B1 7/2004 Bartley et al.
6,779,211 B1 8/2004 Williams
6,810,545 B1 11/2004 Darling et al.
6,842,925 B1 1/2005 Owens et al.
6,851,143 B2 2/2005 Matthews Brown
6,857,150 B2 2/2005 Matthews Brown et al.
D503,062 S 3/2005 Nash
6,877,176 B2 4/2005 Houghteling
6,918,148 B2 7/2005 Auxilia
6,918,149 B2 7/2005 Gowaty
6,944,898 B2 9/2005 Matthews Brown et al.
6,954,942 B2 10/2005 Austin
7,000,274 B2 2/2006 Matthews Brown et al.
7,000,275 B2 2/2006 Matthews Brown
7,000,766 B2 2/2006 Matthews Brown et al.
7,010,821 B1 3/2006 Leach
7,017,212 B2 3/2006 Matthews Brown
7,055,196 B2 6/2006 Littlehorn
7,059,000 B2 6/2006 Verbovszky
7,080,810 B2 7/2006 Munjed
7,089,639 B2 8/2006 Matthews Brown et al.
7,108,646 B1 9/2006 Quick
7,111,347 B1 9/2006 Cottrell
7,127,760 B2 10/2006 Bartley et al.
7,131,156 B1 11/2006 Walker-Craft
7,146,663 B2 12/2006 Brown et al.
7,168,114 B1 1/2007 Larenas
7,251,846 B1 8/2007 Elkin
7,290,303 B2 11/2007 Mead et al.
7,322,061 B2 1/2008 Carroll
7,331,073 B2 2/2008 Littlehorn et al.
D567,562 S 4/2008 Nash
7,353,551 B2 4/2008 Racovolis
7,356,861 B1 4/2008 Pagano
D571,596 S 6/2008 Alvistur et al.
7,386,902 B2 6/2008 Wilson
7,404,222 B2 7/2008 Tidwell
D578,818 S 10/2008 Margalit
D579,256 S 10/2008 Alfieri et al.
7,430,774 B2 10/2008 Littlehorn et al.
7,451,508 B2 11/2008 Matthews Brown et al.
7,464,423 B2 12/2008 Goodwin et al.
7,472,443 B2 1/2009 Littlehorn et al.
7,478,867 B2 1/2009 Weng
7,513,001 B1 4/2009 Leach
D592,438 S 5/2009 Schottin
D593,787 S 6/2009 Dafna
7,540,049 B2 6/2009 Gagliano et al.
7,547,071 B2 6/2009 Huffman
7,562,406 B1 7/2009 Leach
D599,603 S 9/2009 Berland et al.
7,587,773 B2 9/2009 Littlehorn et al.
7,624,461 B2 12/2009 Tidwell et al.
7,640,598 B1 1/2010 Mallik
7,657,955 B1 2/2010 Alvistur et al.
7,676,871 B1 3/2010 Leach
7,682,324 B2 3/2010 Pillarl
7,703,159 B2 4/2010 Parrilla
7,712,169 B2 5/2010 Kovalyak
7,716,765 B1 5/2010 Lakov
7,752,692 B1 7/2010 Sanders et al.

(56) References Cited

U.S. PATENT DOCUMENTS

D624,344 S 9/2010 Kashey
7,788,752 B2 9/2010 Tidwell et al.
D624,777 S 10/2010 Pepys
7,810,191 B2 10/2010 Littlehorn et al.
7,810,192 B2 10/2010 Fujita et al.
7,832,036 B2 11/2010 Littlehorn et al.
7,886,381 B2 2/2011 Aiken et al.
7,900,303 B2 3/2011 Mastrosimone-Gese
7,926,135 B1 4/2011 Leach
D652,666 S 1/2012 Lindsay
D663,564 S 7/2012 Sclare
D669,981 S 10/2012 Ruiz, Sr. et al.
D672,596 S 12/2012 Sclare
8,321,977 B1 12/2012 Kummerfeld et al.
8,418,295 B2 4/2013 Clark
8,460,053 B2 6/2013 Fair et al.
8,468,627 B2 6/2013 Leach
8,485,601 B2 7/2013 Fair et al.
8,495,775 B2 7/2013 Fair et al.
8,516,638 B2 8/2013 Kummerfeld et al.
8,550,548 B2 10/2013 Gibbons et al.
8,590,078 B1 11/2013 Zenoff
8,595,872 B2 * 12/2013 Tidwell ..... A47D 13/083 5/655
D699,982 S 2/2014 Fair et al.
8,650,663 B2 2/2014 Fair et al.
8,696,400 B2 4/2014 Fair et al.
D704,963 S 5/2014 McNeil et al.
8,763,183 B2 7/2014 Tidwell
8,764,109 B2 7/2014 Kummerfeld et al.
D713,171 S 9/2014 Fair et al.
8,863,334 B2 10/2014 Gibbons et al.
8,882,557 B2 11/2014 Fair et al.
8,950,029 B2 2/2015 Tidwell
8,950,808 B2 2/2015 Kummerfeld et al.
9,113,719 B2 8/2015 Kummerfeld et al.
9,138,072 B1 9/2015 Sanders et al.
9,155,974 B2 10/2015 Fair et al.
9,232,863 B1 1/2016 Zenoff
9,265,357 B2 2/2016 Fang
9,271,581 B2 3/2016 Williams
9,307,842 B2 4/2016 Gibbons
9,510,692 B2 12/2016 Hulijev
9,532,657 B2 1/2017 Sclare et al.
9,687,084 B2 6/2017 Sclare et al.
9,775,452 B2 10/2017 Gibbons et al.
9,776,098 B2 10/2017 Fair et al.
9,796,403 B2 10/2017 Fair et al.
9,877,597 B2 1/2018 Sclare et al.
9,936,820 B2 4/2018 Sclare et al.
9,968,148 B2 5/2018 Gibbons et al.
D844,973 S 4/2019 Gibbons
10,264,832 B2 4/2019 Gibbons
10,264,894 B2 4/2019 Gibbons
D864,611 S 10/2019 Gao
D867,020 S 11/2019 Bausch
10,555,620 B2 2/2020 Gibbons
10,588,828 B2 3/2020 Gibbons et al.
D882,244 S 4/2020 Gibbons
D908,395 S 1/2021 David
D910,309 S 2/2021 Gibbons
D914,398 S 3/2021 Gao
D923,971 S 7/2021 Qiu
11,154,147 B2 10/2021 Adeeb, Jr.
D942,180 S 2/2022 Picone et al.
D944,564 S 3/2022 Qiu
D966,745 S 10/2022 Liu
D978,571 S 2/2023 Crist
12,279,702 B1 4/2025 Gibbons et al.
12,342,940 B1 7/2025 Gibbons
2001/0044968 A1 11/2001 Schmitter et al.
2002/0146673 A1 10/2002 Aranas
2004/0060116 A1 * 4/2004 Matthews Brown ..... A47D 13/083 5/636
2004/0075318 A1 4/2004 Wroobel
2004/0130194 A1 7/2004 Wroobel
2005/0005359 A1 * 1/2005 Matthews Brown ..... A47C 20/025 5/655
2005/0225137 A1 10/2005 Mead et al.
2006/0075563 A1 4/2006 Bartner et al.
2006/0179574 A1 8/2006 Margalit
2006/0260057 A1 11/2006 Dunn et al.
2006/0265809 A1 11/2006 Wagner
2007/0056110 A1 3/2007 Tuoriniemi et al.
2007/0056111 A1 3/2007 Lastman
2007/0186346 A1 8/2007 Jensen
2007/0209115 A1 9/2007 Carroll
2007/0246492 A1 10/2007 Carpentieri
2008/0010750 A1 1/2008 Tidwell
2008/0141462 A1 6/2008 Woods
2009/0007335 A1 1/2009 Tidwell
2009/0038078 A1 2/2009 House
2009/0094749 A1 * 4/2009 Littlehorn ..... A47C 16/02 5/490
2009/0199343 A1 8/2009 Collins
2009/0235459 A1 * 9/2009 Tidwell ..... A47G 9/10 5/655
2010/0117431 A1 5/2010 Huffman
2011/0023236 A1 2/2011 Sanders et al.
2011/0119833 A1 5/2011 Clark
2011/0173755 A1 7/2011 Whittaker
2011/0277210 A1 11/2011 Hardesty
2012/0073058 A1 3/2012 Sclare et al.
2012/0240339 A1 * 9/2012 Fair ..... A47D 13/083 5/655
2012/0284924 A1 * 11/2012 Pratt ..... A47G 9/10 5/640
2013/0145556 A1 6/2013 Kummerfeld et al.
2013/0263377 A1 * 10/2013 Wootten, Jr. ..... A47C 27/15 5/640
2014/0215719 A1 * 8/2014 Gibbons ..... A47C 20/021 5/632
2014/0283303 A1 9/2014 Rochlin
2015/0040320 A1 2/2015 Gibbons
2015/0257556 A1 9/2015 Morin
2016/0066707 A1 3/2016 Telford et al.
2017/0313021 A1 11/2017 Chakravarty et al.
2019/0014914 A1 1/2019 Sternlight et al.
2020/0214452 A1 * 7/2020 DuPré ..... A47G 9/1081
2020/0237123 A1 7/2020 Yu
2021/0127867 A1 5/2021 Lee
2021/0235885 A1 * 8/2021 Gibbons ..... A47D 13/083
2021/0282565 A1 9/2021 Champ
2022/0061552 A1 3/2022 Savary
2023/0172370 A1 * 6/2023 Sauceda ..... A47D 13/083 5/655
2024/0049884 A1 2/2024 Sternlight

FOREIGN PATENT DOCUMENTS

KR 20190111879 A 10/2019
WO 96/14008 A1 5/1996

OTHER PUBLICATIONS

Snuggleme Feeding + Support Pillow I Milk—Snuggle Me Organic product description, retrieved from www.snugglemeorganic.com/products/feeding-support-pillow-milk , accessed on Jan. 7, 2021, 3 pages.

Itzy Ritzy Infant Nursing Pillow—Milk Boss Breastfeeding and Bottle Feeding Pillow and Positioner—Rotates Around Arm to Offer Varying Levels of Cushion and Relieve Arm Strain, Plantinum Helix, Amazon product page, retrieved from www.amazon.com:itzyritzyinfantnursingpillow, accessed on Jan. 7, 2021, 11 pages.

Kushies GoPillow™ Wearable Breastfeeding Pillow in Berry product description, retrieved from www.kushiesonline.com, accessed on Jan. 8, 2021, 5 pages.

La Millou nursing pillow product page, retrieved from www.lamillou-us.com/catalogsearch/result/ , accessed on Jan. 7, 2021, 8 pages.

(56) References Cited

OTHER PUBLICATIONS

Lansinoh Nursie Nursing Pillows for Breastfeeding product description, retrieved from www.lansinoh.com/products/nursie-breastfeeding-pillow, accessed on Jan. 8, 2021, 2 pages.
Littlebeam Portable and Versatile Baby Bottle and Breastfeeding Nursing Support Pillow with Memory Foam, Amazon product page, retrieved from www.amazon.com/littlebeam-portable-versatile-breastfeeding-nursing/, accessed on Jan. 7, 2021, 8 pages.
Humble Bee Nurse Sling Nursing Pillow, retrieved from https://humble-bee.com/pages/nursesling-nursing -pillow, accessed Jan. 8, 2021, 7 pages.
Petona breastfeeding pillow, retrieved from www.etsy.com/listing/709939233/breastfeeding-pillow-small-cotton, accessed Jan. 7, 2021, 4 pages.
Office Action Mailed Aug. 18, 2023 from the European Patent Office for Appln No. 20 845 315.9, 5 pages.
Federal Register, The Daily Journal of the United States Government, Safety Standard for Nursing Pillows, A Proposed Rule by the Consumer Product Safely Commission on Sep. 26, 2023, retrieved from www.federalregister.gov/documents/2023/09/26/2013-02156/safety-standard-for-nursing-pillows, accessed Aug. 5, 2024, 47 pages.
U.S. Appl. No. 18/795,735 , Non-Final Office Action, Mailed On Oct. 2, 2024, 17 pages.
U.S. Appl. No. 18/795,735 , Notice of Allowance, Mailed On Dec. 20, 2024, 11 pages.

* cited by examiner

FIRM SUPPORT PILLOW

BACKGROUND

The embodiments herein relate generally to the field of support pillows. Many adults or adolescents participate in activities which make it desirable to support certain objects or body parts. Although some support structures have been used for supporting objects or body parts, such as the arms of a chair, such structures are often uncomfortable and inconvenient to use. Further, some support structures are not easily portable, thereby limiting their use. This invention provides various improvements to support pillows.

BRIEF DESCRIPTION

One embodiment comprises a support pillow that comprises a pillow body having a substantially straight medial region. The pillow body further comprises a substantially straight first arm extending from the substantially straight medial region and a first free end. The pillow body further comprises a substantially straight second arm extending from the substantially straight medial region and a second free end. The distance between the first free end and the second free end is at least 8 inches. In one aspect, the first arm, the medial region, and the second arm define an outer periphery and an inner periphery. Further, the inner periphery defines a curved support cavity, and the curved support cavity defines an average radius of curvature between 4 inches and 7.5 inches, and the first free end and the second free end have a length in a range from 7 inches to 8 inches. The support pillow further comprises a fabric shell enclosing an amount of a fill material that provides substantially all of the pillow body with a prescribed firmness where a force of at least 10 Newtons applied over at least 30 seconds is required to displace a 3-inch diameter hemispheric probe 1 inch into the pillow body. The fabric shell further comprises a first piece, a second piece, and a gusset connected to the first piece and the second piece, and extending around the inner periphery and the outer periphery.

In another embodiment, a support pillow comprises a pillow body having a substantially straight medial region, a substantially straight first arm extending from the substantially straight medial region and a first free end. The pillow body further comprises a substantially straight second arm extending from the substantially straight medial region and a second free end. The first arm, the medial region, and the second arm define an outer periphery and an inner periphery. Further, the inner periphery defines a curved support cavity that defines an average radius of curvature between 4 inches and 7.5 inches, and the first free end and the second free end have a length in a range from 7 inches to 8 inches. The support pillow further comprises a fabric shell enclosing an amount of a fill material such that the support pillow has a prescribed firmness where the middle of the medial region and the arms protrude above a gusset by up to 2.5 inches. The fabric shell further comprises a first piece, a second piece, and the gusset connected to the first piece and the second piece. The gusset extends around the inner periphery and the outer periphery and comprises a first edge along a first end of the gusset with a first end width between 2 inches and 33 inches. The gusset further comprises a second edge along a second end of the gusset with a second end width between 2 inches and 3 inches. The gusset further comprises a portion between the first end of the gusset and the second end of the gusset that has a width between 1.5 inches and 2 inches. The gusset further comprises a third edge having a length between 50 inches and 56 inches connecting the first edge and the second edge.

Another embodiment provides a slipcover for a pillow. The slip cover comprises a cover body comprising a first piece and a second piece. The cover body also defines an open interior that is adapted to receive the pillow, the cover body having a first medial region and two arms extending from the first medial region to define an outer periphery and an inner periphery. The pillow is constructed of a pillow body comprising a second substantially straight medial region. The pillow body further comprises a substantially straight first arm extending from the second substantially straight medial region and a first free end. The pillow body further comprises a substantially straight second arm extending from the second substantially straight medial region and a second free end. A distance between the first free end and the second free end is at least 8 inches. Also, the first arm, the medial region, and the second arm define the outer periphery and the inner periphery. The inner periphery defines a curved support cavity, and the curved support cavity defines an average radius of curvature between 4 inches and 7.5 inches. Further, the first free end and the second free end have a length in a range from 7 inches to 8 inches.

Another embodiment provides a slipcover for a pillow. The slipcover comprises a cover body comprising a first surface and a second surface. The cover body also defines an open interior that is adapted to receive the pillow, the cover body having a medial region and two arms extending from the medial region to define an outer periphery and an inner periphery. The cover body further comprises a bolster at the outer periphery which extends along a majority of the medial region and protrudes away from the first surface.

Another embodiment provides a pillow body with a slipcover placed about the pillow body. The slip cover comprises a cover body comprising a first surface and a second surface. The cover body defines an open interior that is adapted to receive the pillow body, has a medial region, and two arms extending from the medial region to define an outer periphery and an inner periphery. Further the cover body comprises a bolster at the outer periphery which extends along a majority of the medial region and protrudes away from the first surface.

Another embodiment provides a slipcover for a pillow. The slipcover comprises a cover body comprising a first surface and a second surface. The cover body defines an open interior that is adapted to receive the pillow. The cover body has a medial region and two arms extending from the medial region to define an outer periphery and an inner periphery. Further, the cover body comprises a gusset connected to the first surface and the second surface. The gusset extends around the inner periphery and the outer periphery. The cover body further comprises a bolster shell at the outer periphery extending along a majority of the medial region and protruding away from the first surface.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION

Embodiments disclosed herein generally relate to support pillows and slipcovers that may be used with such pillows. The support pillows may be used with or without a slipcover. Also, various features of a slipcover could be incorporated directly into the support pillow as described herein.

The pillows are configured such that a prescribed firmness and shape are achieved. The firmness of the pillows can improve spinal alignment, provide support for infants and users of the pillows, and increase the comfort infants and users experience. The shape of the pillows may also improve spinal alignment, support, pressure relief. Furthermore, the shape can further improve the versatility of the pillow so that the pillow can be stored, carried, and/or used in multiple ways.

Figure 1:
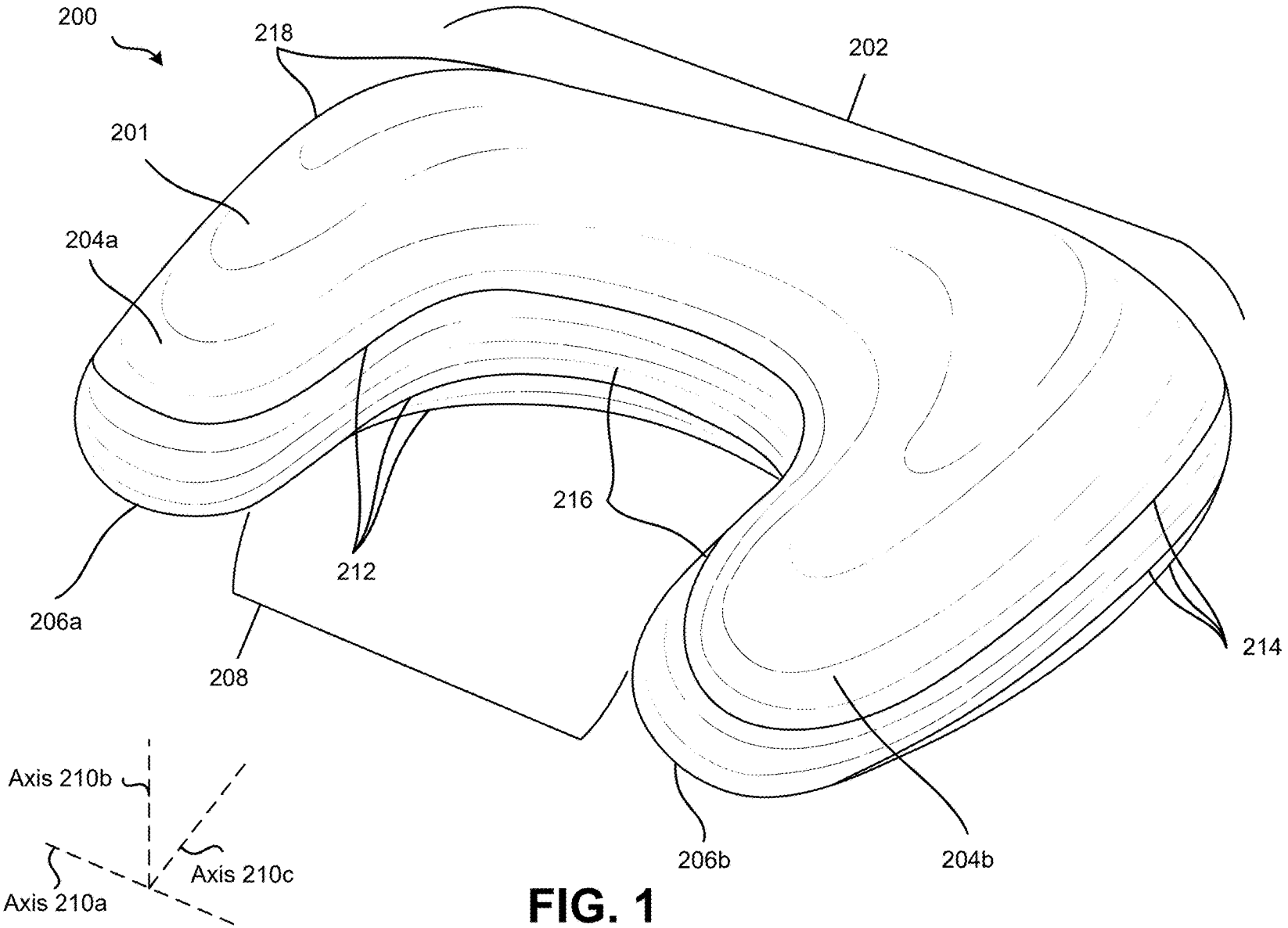
FIG. 1 illustrates a support pillow, according to certain embodiments.

FIG. 1 illustrates a support pillow 200, according to certain embodiments. The support pillow may include a pillow body 201 including a pillow medial region 202, a first pillow arm 204*a* extending from the pillow medial region 202 and having a first free pillow end 206*a*, and a second pillow arm 204*b* extending from the pillow medial region 202 and having a second free pillow end 206*b*. The first pillow arm 204*a*, the pillow medial region 202, and the second pillow arm 204*b* may define an outer periphery 218 and an inner periphery 216.

The pillow body 201 defines a vertical axis 210*b* within a curved support cavity about which the pillow body 201 curves. The pillow body 201 also has an outer peripheral edge 214 and an inner peripheral edge 212. Support pillow 200 illustrates the outer peripheral edge 214 and inner peripheral edge 212 may both curve about the vertical axis 210*b* defined by the pillow body 201, although in other instances only one of the outer peripheral edge 214 or inner peripheral edge 212 may curve about the vertical axis 210*b*. A curvature of the outer peripheral edge 214 may correlate or correspond with a curvature of the inner peripheral edge 212. The outer peripheral edge 214 and/or the inner peripheral edge 212 may be rounded along axis 210*a* and axis 210*c*.

The pillow medial region 202 may be substantially straight. In certain embodiments, the pillow medial region 202 may have a length between about 18 inches to about 28 inches, in some cases from about 20 inches to about 26 inches, and in other cases from about 22.6 inches to about 23.6 inches. A smaller sized support pillow 200 may not offer adequate support to balance out a baby's body weight, which could cause fatigue for a caregiver.

The length of the pillow medial region 202 may extend along an axis 210*a* perpendicular to a different axis 210*c* that the first pillow arm 204*a* and/or the second pillow arm 204*b* extend along. The pillow medial region 202 may include rounded edges that curve toward a gusset of the support pillow 200. In certain embodiments, the pillow medial region 202 may include a thickness measured along axis 210*b* which is greater than the thickness of the first free pillow end 206*a* and/or the thickness of the second free pillow end 206*b*. The thickness may taper between the pillow medial region 202 and the first free pillow end 206*a* and/or the second free pillow end 206*b*. The thickness of the pillow medial region 202 may be between about 2 inches to about 12 inches thick, in some cases from about 3 inches to about 10 inches thick, and in other cases from about 4 inches to about 9 inches thick. The difference in thickness between the pillow medial region 202 and a free pillow end may be between about 3 inches to about 5 inches, in some cases from about 1 inch to about 3 inches, and in other cases from about 0.5 inches to about 1 inch. In certain embodiments, the thickness is roughly equivalent (e.g., plus or minus 0.5 inches) at the first free pillow end 206*a*, the second free pillow end 206*b*, and the pillow medial region 202. The roughly equivalent thickness results in the support pillow 200 having a relatively flat or level upper and/or lower surface, which may aid in supporting and cushioning a child.

The first pillow arm 204*a* and/or the second pillow arm 204*b* may be substantially (e.g., a center line running plus or minus 10 degrees off axis 210*c*) straight. The first pillow arm 204*a* may be parallel with respect to the second pillow arm 204*b*. The first pillow arm 204*a* and/or the second pillow arm 204*b* may extend along axis 210*c* and in a direction perpendicular to axis 210*a*.

In certain embodiments, the first pillow arm 204*a* and/or the second pillow arm 204*b* extend between about 5 inches to about 12 inches, in some cases from about 6 inches to about 9 inches, and in other cases from about 7 inches to about 8 inches from the pillow medial region 202. In certain embodiments, the first pillow arm 204*a* and/or the second pillow arm 204*b* extend between 7 inches and 8 inches from the pillow medial region 202. The length that each arm extends from the pillow medial region may be measured from the edge of the inner periphery 216 along axis 210*a* (as seen in FIG. 2C), extending towards the first free pillow end 206*a* and second free pillow end 206*b*.

The first pillow arm 204*a* may include a first free pillow end 206*a* opposite of the pillow medial region 202 the first pillow arm 204*a* extends from. The second pillow arm 204*b* may include a second free pillow end 206*b* opposite of the pillow medial region 202 the second pillow arm 204*b* extends from. The first free pillow end 206*a* and/or the second free pillow end 206*b* may be blunt. A distance between the first free pillow end 206*a* and the second free pillow end 206*b* at the inner periphery 216 and measured along the axis 210*a* may be at least 8 inches. In certain embodiments, the distance between the first free pillow end 206*a* and the second free pillow end 206*b* at the inner periphery 216 and measured along the axis 210*a* may be at least 9 inches. In certain embodiments, the support pillow 200 comprises a width between about 11 inches to about 20 inches, in some cases from about 13 inches to about 18 inches, and in other cases from about 15 inches to about 16 inches. The width may be measured along axis 210*c*.

The size and angle of the support pillow 200 is ideal for various feeding scenarios and accommodates seats of various size. The shape and size of the support pillow 200 improves a caregiver's ability to properly position an infant or baby while feeding the infant or baby in a safe and efficient manner. The support pillow 200 is designed to comfortably serve consumers of a wide range of body types and infants or babies. Comfort can be achieved, in part, by the formation of the curved support cavity defined by the inner periphery 216. The support cavity may define an average radius of curvature of at least between 4 inches and 7.5 inches (e.g., 5.5 inches in some embodiments). The "average radius of curvature" is meant to define the geometric radius of a hypothetical semi-circle arc between the inner periphery 216 of the first pillow arm 204*a* and the inner periphery 216 of the second pillow arm 204*b*. In certain embodiments, the hypothetical semi-circle arc may be between two ends of the outer periphery 218. The inner periphery 216 need not identically follow a geometry arc. Comfort can be achieved, in part, by a curved design that conforms to a caregiver's body while fully supporting the weight and length of the baby. The pillow body 201 can include fill material (not shown) and a fabric shell that encloses the fill material. The fill material may include any combination of synthetic batting, foam, cotton, wool, feathers, plastic pellets, or dried grains. The fabric shell may include any material combination of polyester, cotton, linen, silk, satin, wool, nylon, rayon, or microfiber. In certain embodiments, the fabric shell includes 80% polyester and 20% cotton. One having ordinary skill in the art with the benefit of the present disclosure would recognize other materials that may be used in the described embodiments.

The fabric shell can enclose an amount of a fill material that provides substantially all of the pillow body 201 with a prescribed firmness where a force of at least 10 Newtons is required to displace a 3-inch diameter hemispheric probe one inch into the pillow body 201. In certain embodiments, fill material provides pillow body 201 with the prescribed firmness such that the 3-inch diameter hemispheric probe can be pressed against pillow body 201 with up to 10 Newtons of force for at least 30 seconds with the pillow body 201 deflecting by 1 inch or less. For some uses, the firmness of the pillow body 201 will be greater than the above described firmness (e.g., capable of withstanding greater force and/or for longer time), while for other uses, the firmness may be less than the above prescribed firmness.

In certain embodiments, the support pillow 200 may be used with a slipcover (e.g., any of the slipcover embodiments described herein). The slipcovers described herein may help keep the support pillow 200 clean, reduce odor of the support pillow 200, have a different texture than support pillow 200. The different texture may be useful for comfort and/or for increasing the grip in one or more portions of the slipcover (e.g., to reduce sliding while being used). The slipcovers described herein may help regulate temperature of the user or an infant. The slipcovers described herein may protect the support pillow 200 fabric and prolong the life of support pillow 200, may be waterproof, and/or may add further support for body parts of the user or infant.

Figure 2A:
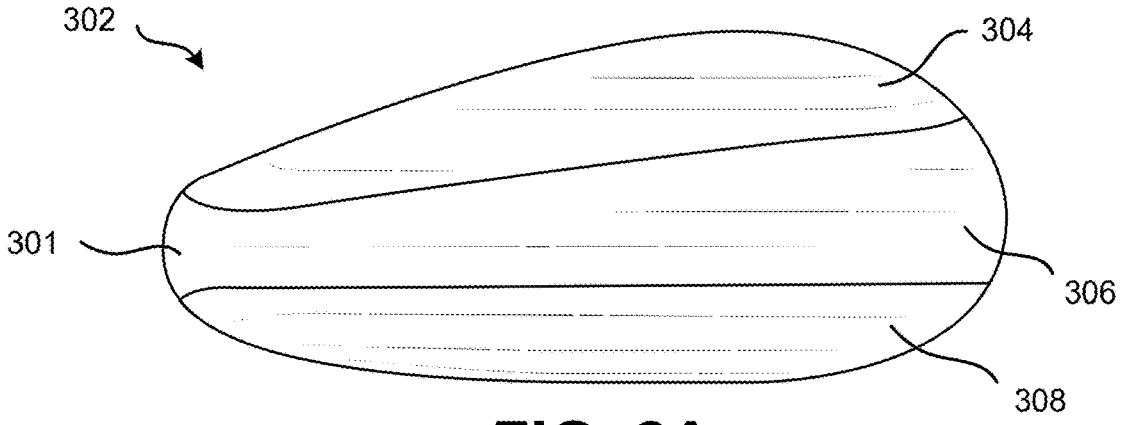
FIGS. 2A-C illustrate different perspective views of a support pillow, according to certain embodiments.
Figure 2B:
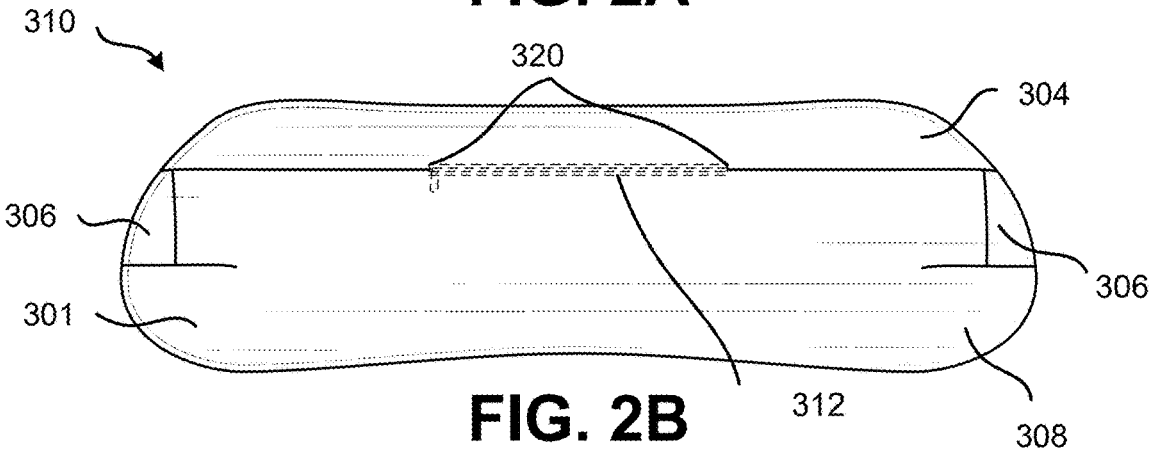
Figure 2C:
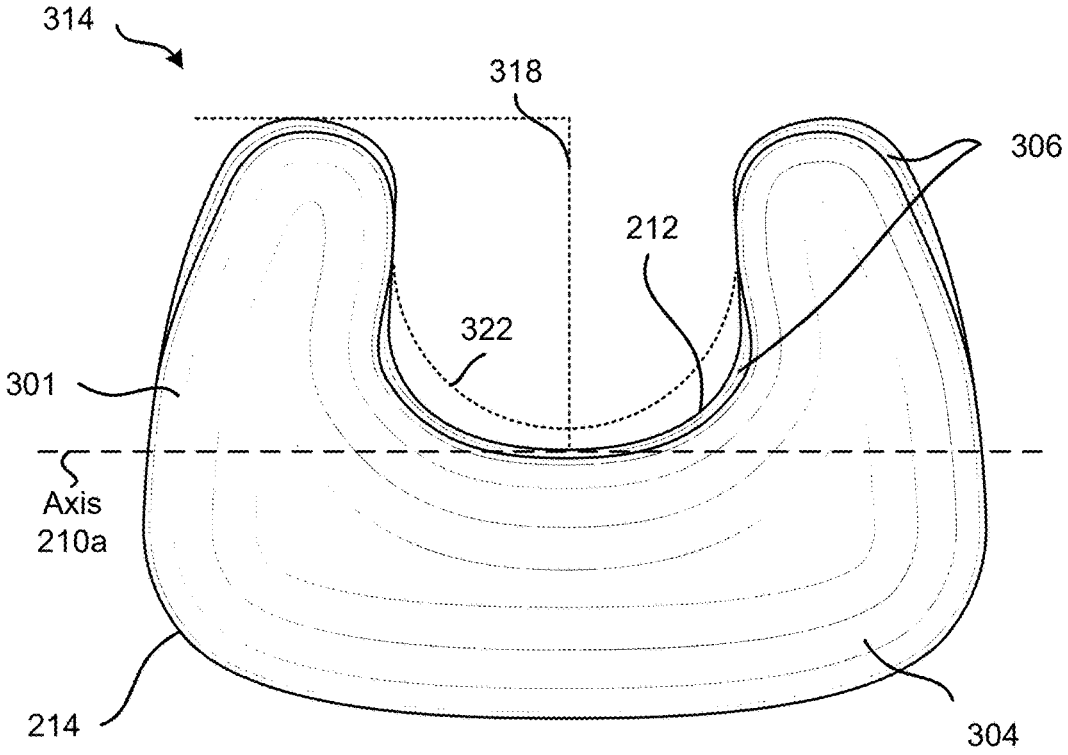

FIGS. 2A-C illustrate different perspective views of support pillow 200. The support pillow 200 includes a fabric shell 301. The fabric shell 301 may include a first piece 304, a gusset 306, a second piece 308, and a zipper 312.

FIG. 2A illustrates a view from the right side 302 of the support pillow 200. While the support pillow 200 is illustrated as having a slight taper, the support pillow 200 can alternatively be generally flat. The shape of the support pillow 200 can be dictated by the shape of the fabric used for the first piece 304, the second piece 308, and the gusset 306.

The gusset 306 may be a strip or section of material that is sewn to the first piece 304 (e.g., a top piece) and the second piece 308 (e.g., a bottom piece) of the fabric shell 301 of the pillow body 201. Seams may be formed where the gusset 306 is sewn to the first piece 304 and the second piece 308.

In certain embodiments, the seams and/or other seams described herein may be configured to withstand at least 15 pounds of tension force. In certain embodiments, the seams and/or other seams described herein may be configured to withstand at least a four lb-in. (0.4 N-m) torque in a clockwise rotation to 180 degrees and maintained for ten seconds before support pillow 200 is released, allowed to return to relaxed state, and the four lb-in. (0.4 N-m) of torque is applied in a counter clockwise rotation to 180 degrees and maintained for ten seconds. In certain embodiments, the seams and/or other seams described herein may be configured to withstand at least a 15 lb (67 N) force over five seconds or ten seconds, in a direction to remove the component. Other components (e.g., surfaces, pieces, portions, gussets, connectors, fasteners, pockets, straps, etc.) may be additionally or alternatively be subjected to the above strength standards. The seam strength and/or other component strengths can help ensure the fill material can be compacted within the fabric shell 301 to an amount needed to provide the desired firmness without bursting the seam. The strength may prevent fill material from being released from the support pillow 200. The strength of components and/or materials may prevent components from coming loose and/or tearing.

The gusset 306 may extend along a mid-plane of the pillow body 201. The gusset 306 may extend around the inner periphery 216 and the outer periphery 218 of the pillow. The gusset 306 may have ends that are sewn to the second piece 308. The end of the gusset 306 may be sewn to the second piece 308 at the back of the support pillow 200. In certain embodiments, the entire width or substantially all of the width of the gusset 306 end is sewn to the second piece 308. The width of the gusset 306 between the gusset ends may be constant or may taper. In certain embodiments, the width of the gusset 306 is the smallest near the middle of the gusset 306 between the gusset ends.

FIG. 2B illustrates a view from the back 310 of the support pillow 200. From the view from the back 310 of the support pillow 200, a zipper 312 may be seen. Although a zipper 312 is illustrated, other types of fasteners may also be used. For example, buttons, stitching, and/or hook and loop fasteners could be used. For simplicity, the zipper 312 is described below to close an opening between the first piece 304 and the second piece 308, but one or more other fasteners may also be used. The zipper 312 may be configured to open and close the opening between the first piece 304 and the second piece 308. The zipper opening may have opening ends 320. The opening ends 320 may be spaced between about 4 inches to about 9 inches apart, in some cases from about 5 inches to about 8 inches apart, and in other cases from about 6 inches and 7 inches apart. The zipper 312 may be located on the interior of the pillow body 201 or the exterior of the pillow body 201. In certain embodiments, the zipper 312 is preferred to be placed on the inside of the pillow body 201.

The opening ends 320 may have any number of back-stitches over a seam joining the first piece 304 and the second piece 308. In certain embodiments, three or more back stitches are used. The back stitches may be used to secure the zipper 312 to the opening while the support pillow 200 is filled to a prescribed firmness (e.g., the firmness described above where a force of at least 10 Newtons is required to displace a 3-inch diameter hemispheric probe one inch into the pillow body 201) that exerts an outward force on the fabric shell 301. A fabric brace may be used in addition to or as an alternative to the back stitches. A fabric brace may be placed on the inside of the fabric shell 301 (the side with the fill material) and stitched to the first piece 304 and the second piece 308. The fabric brace may be included at one or both ends of the zipper opening. In certain embodiments, the zipper 312 is coupled to an elongated flap of the second piece 308 (e.g., described further with respect to FIG. 3). The ends of the zipper 312 may be at the outer periphery 218 of the support pillow.

FIG. 2C illustrates a view from the top 314 of the support pillow 200. As illustrated by the view from the top 314, the inner peripheral edge 212 of the support pillow 200 includes a gusset 306 that is coupled along a vertical midsection of the inner peripheral edge 212 and that extends about or around the curved support cavity of the support pillow 200. The support cavity may define an average radius of curvature of at least between 4 inches and 7.5 inches (e.g., 5.5 inches in some embodiments). The "average radius of curvature" is meant to define the geometric radius of a hypothetical semi-circle 322 between the inner periphery 216 of the first and second pillow arms 204. In certain embodiments, the hypothetical semi-circle may be between two ends of the outer periphery 218. The inner periphery 216 may run along the fabric shell 301 and need not identically follow a geometric arc.

The gusset 306 is adapted to prevent tearing of the pillow body 201 adjacent to the inner peripheral edge 212 of the curved support cavity during use, such as upon movement or deflection of the first free pillow end 206*a* and the second free pillow end 206*b*. The pillow body 201 length measured along axis 210*a* may be between about 19 inches to about 26 inches, in some cases from about 21 inches to about 26 inches, and in other cases from about 23 inches to about 24 inches. In certain embodiments, the middle of the pillow medial region 202 measured along axis 210*a* and the middle of the arms 204 measured along axis 210*a* may protrude above (measured along axis 210*b* described above) the gusset by up to 2.5 inches, 3.5 inches in some embodiments, and 4.5 inches in some embodiments. The height of the protrusion and overall thickness of the support pillow 200 may depend on the amount of fill material enclosed by the fabric shell 301.

The first pillow arm 204*a* and the second pillow arm 204*b* may have a length measured along an axis perpendicular to axis 210*a* (e.g., axis 210*c*) in some cases in the range from 5 inches to about 12 inches, and in other cases in the range from about 6 inches to about 9 inches, and in other cases in the range from 7 inches to 8 inches. In certain embodiments, the first pillow arm 204*a* and the second pillow arm 204*b* may have a length less than or equal to 9 inches. The extension measurement of the pillow arms 204 may be measured along the arm extension dotted line 318 (axis 210*c* as described above). The arm extension may be measured from a free pillow end 206 of a respective pillow arm 204 (e.g., a line tangent to the free pillow end 206) to a furthest portion on an axis perpendicular to axis 210*a* (e.g., axis 210*c* described above) of the inner periphery 216 as shown by the arm extension dotted line 318.

In certain embodiments, the pillow body 201 may include a bolster similar to that described in connection with the slipcover described hereinafter. The bolster may be formed by the fabric shell of the pillow body 201 and may enclose fill material. The fabric shell of the bolster may include a front portion joined with the first piece 304 and a back portion joined with the second piece 308. In such embodiments, the bolster may be part of the support pillow 200 and therefore may reduce the need for a bolster to be located in a slipcover in a corresponding position. For example, the fabric shell of the bolster may enclose fill material to create an additional protruding support surface/barrier/ridge along the outer periphery 218 of the pillow body 201.

Figure 3:
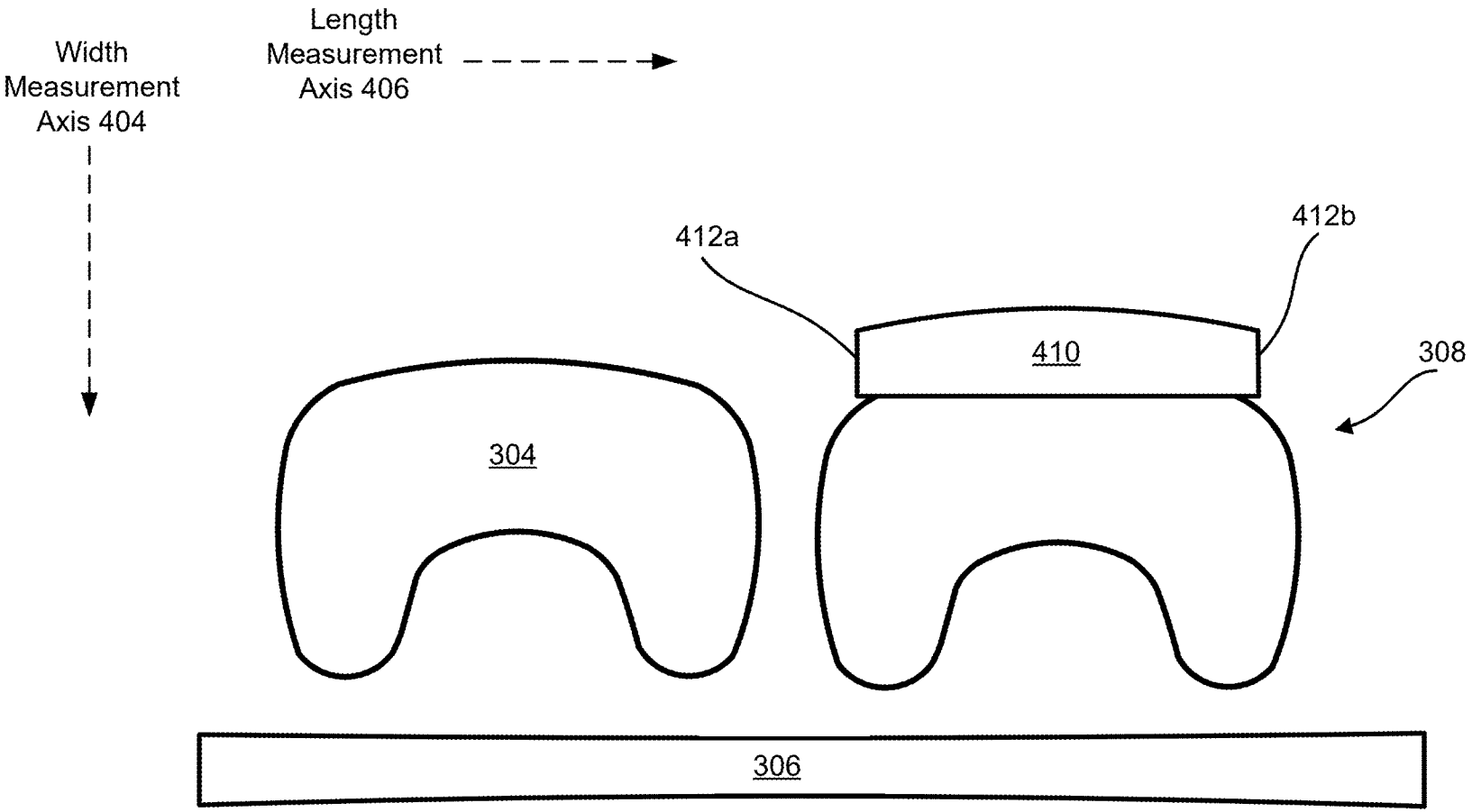
FIG. 3 illustrates shapes of fabric pieces that can be used to form a fabric shell of a support pillow, according to certain embodiments.

FIG. 3 illustrates shapes of fabric pieces that can be used to form fabric shell 301 of support pillow 200, according to certain embodiments. The fabric shell 301 may be the fabric shell 301 described above. The fabric shell 301 may include a first piece 304, a second piece 308, and a gusset 306. The first piece 304, the second piece 308, and/or the gusset 306 may be a single continuous piece or may include multiple (e.g., one or more) pieces coupled together (e.g., via stitching). The pieces may have their respective widths measured with respect to the width measurement axis 404 and their lengths measured with respect to the length measurement axis 406.

The first piece 304 may form a top of the support pillow 200. The first piece 304 may be made of any of the materials used for the fabric shell 301. The first piece 304 may be U-shaped in geometry. In certain embodiments, the first piece 304 may have a width between about 11 inches to about 20 inches, in some cases from about 13 inches to about 18 inches, and in other cases from about 15 inches to about 16 inches. In certain embodiments, the first piece may have a length between about 19 inches to about 26 inches, in some cases from about 21 inches to about 26 inches, and in other cases from about 23 inches to about 24 inches.

The second piece 308 may form a bottom of the support pillow 200. The second piece 308 may be made of any of the materials used for the fabric shell 301. The second piece 308 may include a U-shaped section that corresponds in geometry to the first piece 304. In certain embodiments, the second piece 308 may have a length between 22.63 inches and 23.63 inches.

The second piece 308 may include an elongated flap 410 extending from a rear side of the U-shaped section. An advantage of having the elongated flap 410 as part of second piece 308 can be reducing the number of seams that would otherwise be needed if the material making up the elongated flap 410 was a separate piece from first piece 304, second piece 308, and gusset 306. The width of the elongated flap 410 may also configure the support pillow 200 to have a shape that is thicker and raised up near the back end of the support pillow 200 than in the front of the support pillow 200, which may thereby improve comfort and support of an infant and/or user.

The elongated flap 410 may be coupled with the first piece 304 and/or the gusset 306. The elongated piece may be coupled to a zipper or other fastener, and the zipper or other fastener may be coupled to the first piece 304. The first piece 304 and the second piece 308 may be positioned such that the first piece 304 and the second piece 308 form an opening along the back of the support pillow 200. The zipper or other fastener may be placed along the opening and may enable the opening to be closed.

The elongated flap 410 may include a first flap end 412*a* and a second flap end 412*b*. The first flap end 412*a* may be sewn to the gusset 306. The second flap end 412*b* may be opposite of the first flap end 412*a* and the second flap end 412*b* may be sewn to the gusset 306. The first piece 304 may be sewn to the second piece 308 along the elongated flap 410.

The gusset 306 may be sewn to the first piece 304, the second piece 308, and the elongated flap 410 of the second piece 308. The gusset 306 may be connected (e.g., via stitching) to the first piece 304 and the second piece 308. The gusset 306 may extend around the inner periphery 216 of the support pillow 200. The gusset 306 may partially (e.g., 50%), mostly (e.g., 60%, 70%, 80%), or completely extend around the outer periphery 218 of the support pillow 200.

The gusset 306 may have a tapered shape. The gusset 306 may have a width at a first end of the gusset of between about 1 inch to about 5 inches, in some cases from about 2 inches to about 4 inches, and in other cases from about 2 inches to about 3 inches. The gusset 306 may include a second end opposite of the first end. The second end may have a similar width as the first end (e.g., between 2.25 inches and 2.75 inches). In certain embodiments, a center region of the gusset 306 located between the first end and the second end may have a width between about 1 inch to about 3 inches, in some cases from about 1.0 inches to about 2.5 inches, and in other cases from about 1.5 inches to about 2 inches. In some embodiments, the gusset 306 has a width that is substantially the same along the length of the gusset 306. The length of the gusset 306 may be between about 40 inches to about 66 inches, in some cases from about 46 inches to about 60 inches, and in other cases from about 50 inches to about 56 inches. Shaping gusset 306 in this manner can provide the support pillow 200 with the taper previously described.

Figure 4A:
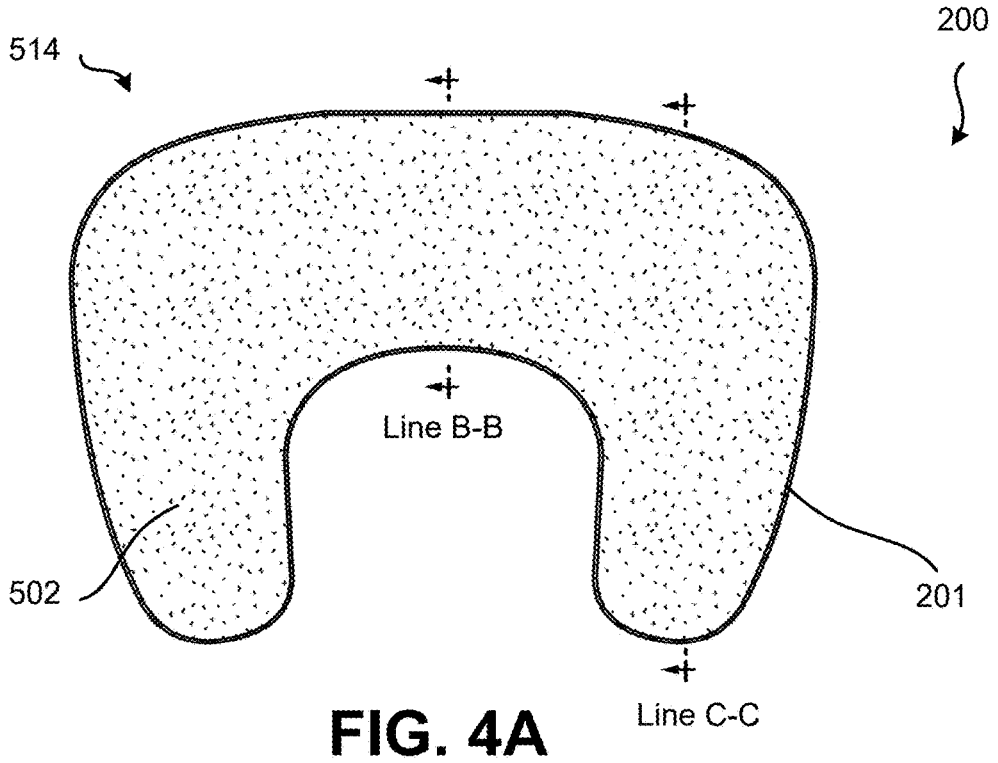
FIGS. 4A-C illustrate cross section views of a support pillow, according to certain embodiments.
Figure 4B:
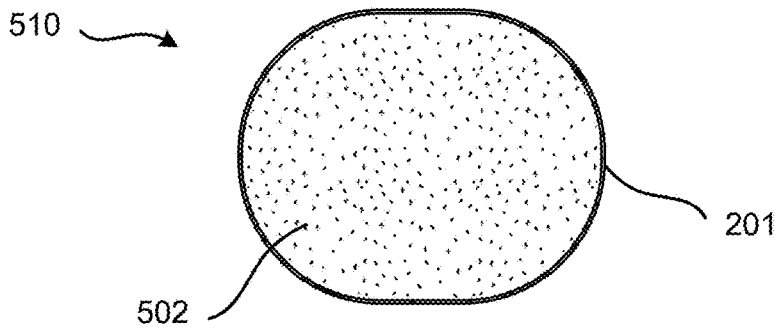
Figure 4C:
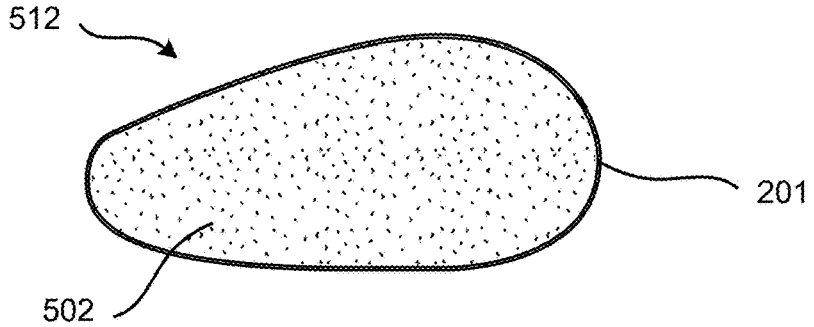

FIGS. 4A-C illustrate cross section views of support pillow 200, according to certain embodiments. The support pillow 200 may be any of the support pillows described herein. The cross section views include a cross section view from a top 514 of the support pillow 200, a first cross section view from a right side 510 of the support pillow 200 and a second cross section view from a right side 512 of the support pillow 200.

FIG. 4A illustrates the cross section view from the top 514 of the support pillow 200 and shows an amount of fill material 502. The fill material 502 may be enclosed by a fabric shell of the pillow body 201. The amount of fill material 502 may be such that the support pillow 200 reaches a prescribed firmness where a force of at least 10 Newtons is required to displace a 3-inch diameter hemispheric probe one inch into the fabric shell. In certain embodiments, fill material 502 provides pillow body 201 with the prescribed firmness such that the 3-inch diameter hemispheric probe can be pressed against pillow body 201 with up to 10 Newtons of force for at least 30 seconds with the pillow body 201 deflecting by 1 inch or less. The section view from the top 514 illustrates a first line B-B across a pillow medial region 202 of the support pillow 200 and a second line C-C across a combination of the pillow medial region 202 and an arm 204 of the support pillow 200. The cross sections are described further below.

FIG. 4B illustrates the first cross section view from the right side 510 of the support pillow 200 along line B-B which is in the medial region. As shown, the pillow medial region 202 may be characterized by an oval shape with flat edges along the top side (e.g., a first piece) and the bottom side (e.g., a second piece). In certain embodiments, the front of the support pillow 200 and the back of the support pillow 200 illustrated by the first cross section from the right side 510 may additionally or alternatively include a flat edge. The flat front edge may be formed by a gusset.

FIG. 4C illustrates the second cross section view from the right side 512 taken along line C-C. As illustrated, the thickness of the pillow medial region 202 may be greater than the thickness at a free pillow end 206 extending from the pillow medial region 202. The thickness may narrow from the pillow medial region 202 to free end 206. The narrowing may be substantially linear. In certain embodiments, the thickness of the pillow medial region 202 illustrated in the second cross section view from the right side 512 may between 6.5 inches and 7.5 inches, and the thickness of the free pillow end 206 of the pillow arm 204 may be between 2.5 inches and 3.5 inches.

Figure 5:
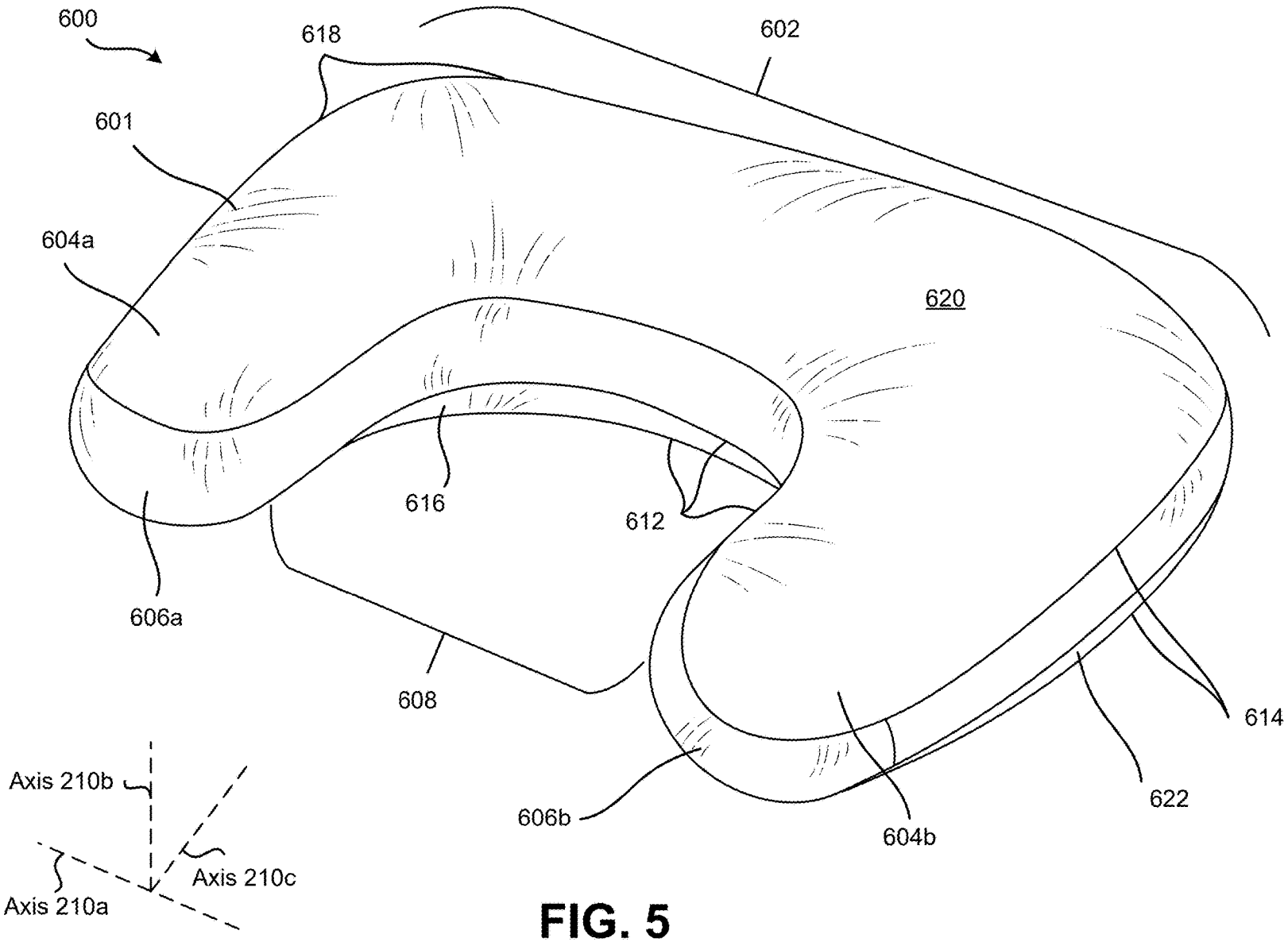
FIG. 5 illustrates a slipcover, according to certain embodiments.

FIG. 5 illustrates a slipcover 600, according to certain embodiments. The slipcover 600 may include a slipcover body 601 including a first surface 620, a second surface 622, and define an open interior adapted to receive a pillow (e.g., support pillow 200). Slipcover 600 is shown in the shape when it encompasses a support pillow. The pillow may be similar to any of the pillows described herein.

The cover body 601 may have a slipcover medial region 602, a first slipcover arm 604*a*, a second slipcover arm 604*b*, a first free slipcover end 606*a*, and a second free slipcover end 606*b*. The first slipcover arm 604*a* and the second slipcover arm 604*b* may extend from the slipcover medial region 602 to define an outer periphery 618 and an inner periphery 616. The cover body 601 may have similar dimensions to a support pillow such that the slipcover 600 may be placed around the support pillow.

The cover body 601 defines a vertical axis 210*b* within a curved support cavity about which the cover body 601 curves. The cover body 601 also has an outer peripheral edge 614 and an inner peripheral edge 612. Slipcover 600 illustrates the outer peripheral edge 614 and inner peripheral edge 612 may both curve about the vertical axis 210*b* defined by the pillow body 601, although in other instances only one of the outer peripheral edge 614 or inner peripheral edge 612 may curve about the vertical axis 210*b*. A curvature of the outer peripheral edge 614 may correlate or correspond with a curvature of the inner peripheral edge 612. The outer peripheral edge 614 and/or the inner peripheral edge 612 may be rounded along axis 210*a* and axis 210*c*.

The slipcover medial region 602 may be substantially straight (e.g., front and back sides running less than ten degrees off axis 210*a*). In certain embodiments, the slipcover medial region may have a length between about 19 inches to about 28 inches, in some cases from about 21 inches to about 26 inches, and in other cases from about 23 inches to about 24 inches. In certain embodiments, the slipcover 600 may have a length that is smaller or larger so that it may be placed around other sizes of pillows.

The length of the slipcover medial region 602 may extend along an axis 210*a* perpendicular to a different axis 210*c* that the first slipcover arm 604*a* and/or the second slipcover arm 604*b* extend along. The slipcover medial region 602 may include rounded edges that curve toward a gusset of the slipcover 600. In certain embodiments, the slipcover medial region 602 may be configured to receive a portion of a pillow with a thickness greater than the thickness of the pillow portion the first free slipcover end 606*a* and/or the second free slipcover end 606*b* is configured to receive. In certain embodiments, the slipcover medial region 602 may be configured to receive a portion of a pillow with a thickness substantially the same (e.g., plus or minus 0.5 inches) as the thickness of the pillow portion the first free slipcover end 606*a* and/or the second free slipcover end 606*b* is configured to receive.

The first slipcover arm 604*a* and/or the second slipcover arm 604*b* may be substantially straight (e.g., a center line running less than ten degrees off of axis 210*c*). The first slipcover arm 604*a* may be parallel with respect to the second slipcover arm 604*b*. The first slipcover arm 604*a* and/or the second slipcover arm 604*b* may extend along axis 210*c* and in a direction perpendicular to axis 210*a*. In certain embodiments, the first slipcover arm 604*a* and/or the second slipcover arm 604*b* extend between about 5 inches to about 12 inches, in some cases from about 6 inches to about 9 inches, and in other cases from about 7 inches to about 8 inches from the medial region. The measurement of the extension length of the arms 604 may be measured similar to the extension length of the pillow arms 204 described above.

The first slipcover arm 604*a* may include a first free slipcover end 606*a* opposite of the slipcover medial region 610 the first slipcover arm 604*a* extends from. The second slipcover arm 604*b* may include a second free slipcover end 606*b* opposite of the slipcover medial region 602 the second slipcover arm 604*b* extends from. The first free slipcover end 606*a* and/or the second free slipcover end 606*b* may be configured to receive a blunt free pillow end. A distance between the first free slipcover end 606*a* and the second free slipcover end 606*b* measured along the axis 210*a* may be at least 8 inches. In certain embodiments, the slipcover 600 comprises a width between about 14 inches to about 20 inches, in some cases from about 14 inches to about 17 inches, and in other cases from about 15 inches to about 16 inches. The width may be measured along axis 210*c* and may include the combined width of the first slipcover arm 604*a* and the slipcover medial region 602.

The shape and size of the slipcover 600 improves a caregiver's ability to properly position an infant or baby while feeding the infant or baby in a safe and efficient manner. The slipcover 600 is designed to comfortably serve consumers of all body types and infants or babies of all ages. Comfort can be achieved, in part, by the formation of the curved support cavity defined by the inner periphery 616. The support cavity may define an average radius of curvature of at least between 4 inches and 7.5 inches (e.g., 5.5 inches in some embodiments). Comfort can be achieved, in part, by a curved design that conforms to a caregiver's body. The fabric shell of the slipcover body 601 may include any material combination of polyester, cotton, polyester microfiber, other microfiber, linen, silk, wool, nylon, rayon, or satin. One having ordinary skill in the art with the benefit of the present disclosure would recognize other materials that may be used in the described embodiments. In certain embodiments, the fabric shell includes 100% polyester microfiber. The fabric shell can receive a pillow such as the support pillow described above (e.g., support pillow 200).

Figure 6A:
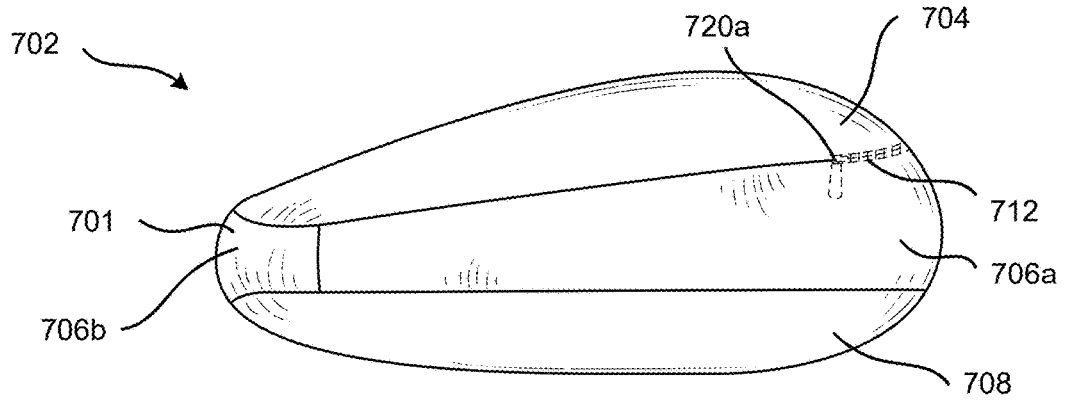
FIGS. 6A-C illustrate different perspective views of a slipcover, according to certain embodiments.
Figure 6B:
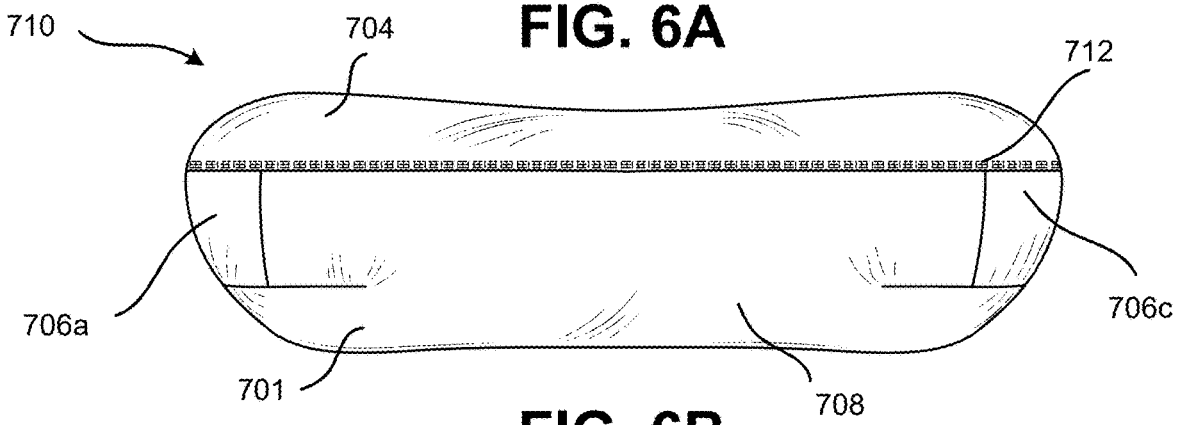
Figure 6C:
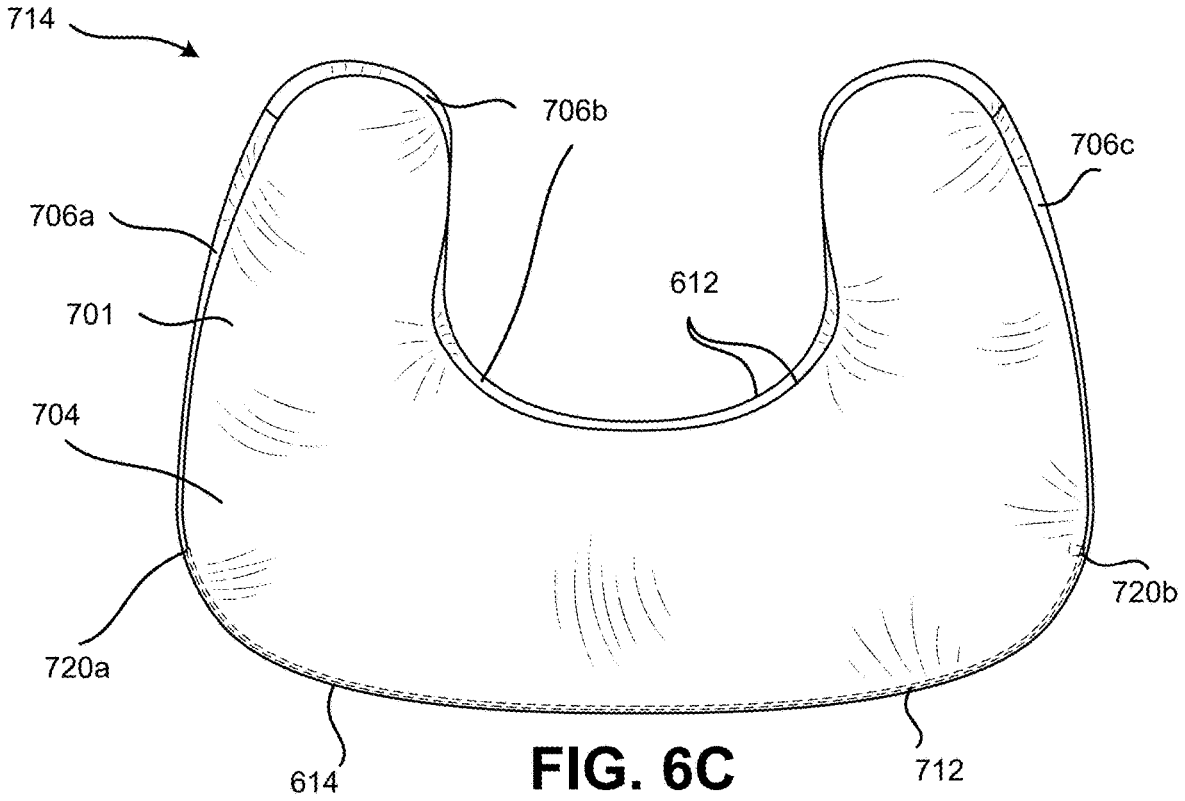

FIGS. 6A-C illustrate different perspective views of slipcover 600 described above. The slipcover 600 may include a fabric shell 701. The fabric shell 701 may include a first piece 704, a gusset 706, a second piece 708, and a fastener 712. The illustrated slipcover 600 may enclose a pillow (e.g., support pillow 200).

FIG. 6A illustrates a view from the right side 702 of the slipcover 600. The slipcover 600 may be configured to receive the pillow. The pillow may be generally flat (e.g., less than 0.5 inches difference between thickest part and narrowest part) or may have a slight taper (e.g., thickness changes more than 0.5 inches between thickest part and narrowest part). The slipcover 600 may cause the support pillow to be oriented in a specific position and firmness based on the shape of the slipcover 600. The shape of the slipcover 600 can be defined by the first piece 704, the second piece 708, and the gusset 706. In the illustrated example, the gusset 706 includes three gusset pieces 706*a*, 706*b*, and 706*c* that are connected to form a combined gusset 706 longer than each of the individual gusset pieces. In certain embodiments, the gusset 706 is made of a single piece or any number of pieces.

The gusset 706 may be strips or sections of material that are sewn to the first piece 704 (e.g., a top piece) and the second piece 708 (e.g., a bottom piece) of the fabric shell 701 of the slipcover body 601. In the embodiments where the gusset 706 includes more than one gusset piece such as the first gusset piece 706*a*, the second gusset piece 706*b*, and the third gusset piece 706*c*. The gusset pieces may be connected together. In certain embodiments a first gusset piece 706*a* includes a first end connected to the first piece 704 and/or second piece 708. A second end opposite the first end may connect to a first end of a second gusset piece 706*b*. The second gusset piece 706*b* may have a second end of the second gusset piece 706*b* connected to a first end of a third gusset piece 706*c*. The third gusset piece 706*c* may include a second end of the third gusset piece 706*c* opposite the first end of the third gusset piece 706*c* that is connected to the first piece 704 and/or the second piece 708. A first side of the first gusset piece 706*a*, the second gusset piece 706*b*, and the third gusset piece 706*c* that extends between the ends of the respective gusset pieces 706 may connect to the first piece 704. A second side of the first gusset piece 706*a*, the second gusset piece 706*b*, and the third gusset piece 706*c* opposite the side of the first side and extending between the ends of the respective gusset pieces 706 may connect to the second piece 708. The gusset 706, the first piece 704, and/or the second piece 708 may be connected by seams. Seams may be formed where the gusset 706 is sewn to the first piece 704 and the second piece 708. In certain embodiments, the seams may be configured to withstand at least 15 pounds of tension force. The seam strength can help ensure that the support pillow can be enclosed within the shell 701 such that a desired firmness is achieved without bursting the seam. The seam strength may prevent tears to the slipcover and thereby may protect the support pillow from being damaged.

The gusset 706 may extend along a mid-plane of the cover body 601. The gusset 706 may extend around the inner periphery 616 and the outer periphery 618 of the slipcover body 601. The gusset 706 may have ends with respective edges that are sewn to the second piece 708. The end of the gusset 706 may be sewn to the second piece 708 at the back of the cover body 601. In certain embodiments, the entire width or substantially all (e.g., 80%, 90%, 95%) of the width of the gusset end is sewn to the second piece 708. The width of the gusset 706 between the gusset ends may be constant or may taper. In certain embodiments, the width of a gusset piece is smallest near the middle of the gusset piece (e.g., second gusset piece 706*b*) between the gusset ends. Different gusset pieces that form the gusset 706 may have different dimensions than one or more of the other gusset pieces that form the gusset 706.

FIG. 6B illustrates a view from the back 710 of the slipcover 600. From the view from the back 710 of the slipcover 600, a fastener 712 may be seen. The fastener 712 may include a zipper, a button, stitching, and/or hook and loop fasteners. The fastener 712 may be configured to open and close the opening between the first piece 704 and the second piece 708. The fastener 712 may be located along an opening. The fastener 712 may be located along portions of the opening or along all of the opening. The opening may have opening ends 720. In certain embodiments, the opening ends 720 may be spaced between about 23 inches to about 32 inches apart, in some cases from about 26.5 inches to about 29.5 inches apart, and in other cases from about 27.5 inches to about 28.5 inches apart. The fastener 712 may be located on the interior of the slipcover body 601 or the exterior of the slipcover body 601. In certain embodiments, the fastener 712 is preferred to be placed on the inside of the slipcover body 601. The fastener 712 may be connected to the first piece 704, the second piece 708, or the gusset 706 via stitching.

The opening ends 720 may have any number of backstitches over a seam joining the first piece 704 and the second piece 708. In certain embodiments, two or more back stitches are used. The back stitches may be used to prevent the opening from tearing and becoming bigger during insertions and removal of a pillow from/to the slipcover 600. A fabric brace may be used in addition to or as an alternative to the back stitches. A fabric brace may be placed on the inside of the fabric shell 701 (the side with the pillow) and stitched to the first piece 704 and the second piece 708. The fabric brace may be included at one or both opening ends 720. In certain embodiments, the fastener 712 is coupled to an elongated flap of the second piece 708 (e.g., described further with respect to FIG. 7). The ends of the fastener 712 may be at the outer periphery 618 of the support pillow.

FIG. 6C illustrates a view from the top 714 of the slipcover 600. As illustrated by the view from the top 714, the inner peripheral edge 612 of the slipcover 600 includes a gusset 706 that is coupled along a vertical midsection of the inner peripheral edge 612 and that extends about or around the curved support cavity of the slipcover 600. The gusset 706 is adapted to prevent tearing of the slipcover 600 adjacent to the inner peripheral edge 612 of the curved support cavity during use, such as upon movement or deflection of the slipcover 600 (e.g., while enclosing a pillow). As illustrated the second gusset piece 706*b* may extend about the curved support cavity. Further, the third gusset piece 706*c* and the first gusset piece 706*a* may extend around most of the outer periphery 618 of the slipcover body 601.

The first slipcover arm 604*a* and the second slipcover arm 604*b* may have a length in the range from between about 5 inches to about 12 inches, in some cases from about 6 inches to about 9 inches, and in other cases from about 7 inches to about 8 inches. The length of the slipcover arms 604 may be measured in a similar fashion as the first pillow arm 204*a* and the second pillow arm 204*b* as described above. For example, the slipcover arm 604 length may be measured from a free slipcover end 606 of a respective slipcover arm 604 to a furthest portion of the inner periphery 616 measured along the axis 210*c* described above.

Although not illustrated with the slipcover 600, in certain embodiments, a strap may be connected to the slipcover 600. The strap may connect to the gusset 706 of the slipcover 600, the first piece 704, and/or the second piece 708. The strap may include two or more ends. The strap may be made of material including, but not limited to, nylon, polyester, polypropylene, Cordura, leather, mesh, cotton, wool, rayon, and/or neoprene. The strap may be configured to detachably connect with the slipcover. The strap may be configured to detachably connect to at least one of: the outer periphery 618 of the first slipcover arm 604*a* or the outer periphery 618 of the second slipcover arm 604*b*. The strap may detachably connect to a connector (e.g., a belt connector). The connector may be connected (e.g., sewn) to the slipcover 600. In certain embodiments, one or more portions of the strap may be connected (e.g., sewn) to the slipcover 600 and not be detachable. In certain embodiments, the strap may include a belt stop snapper described further herein.

Figure 7:
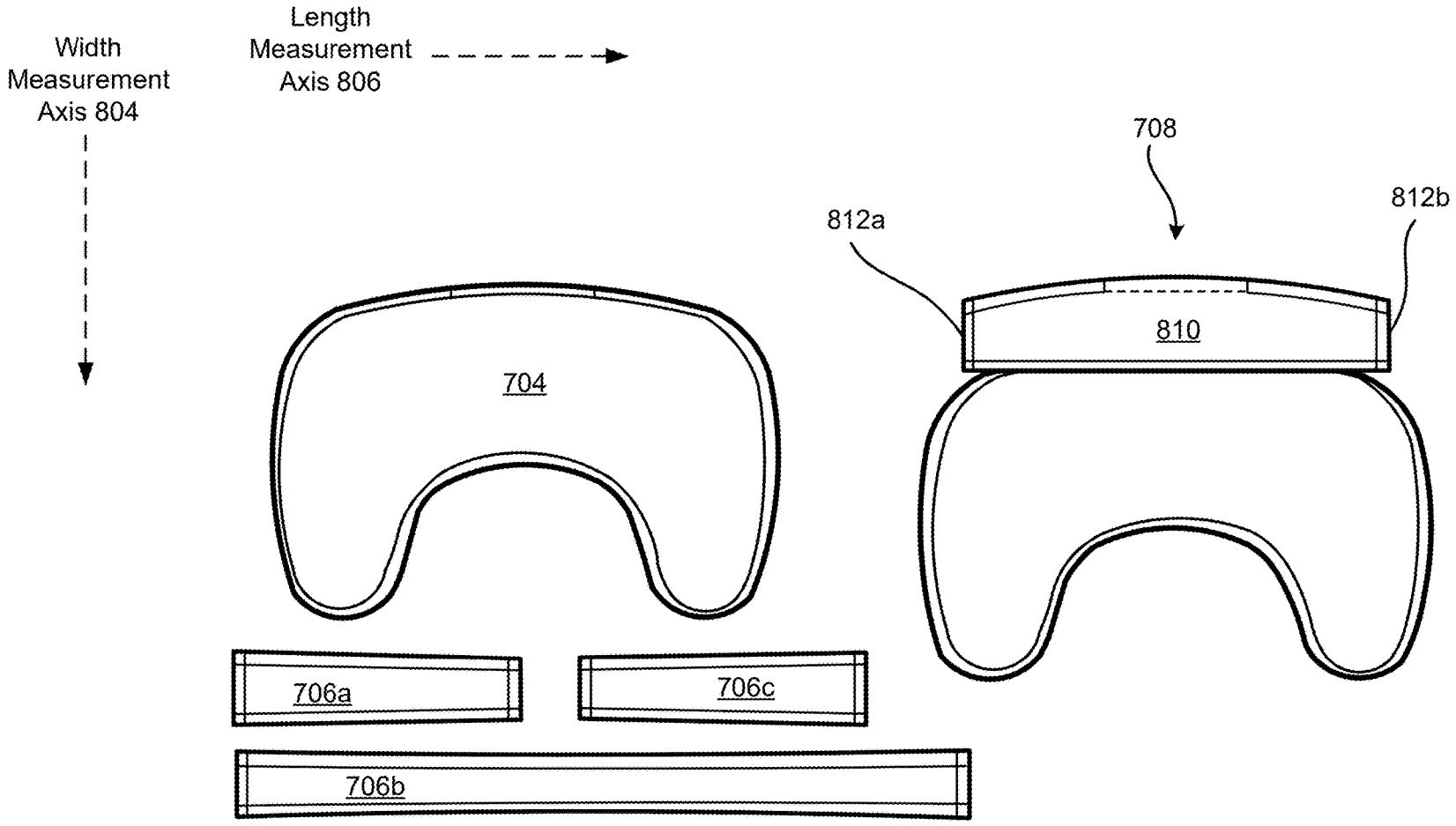
FIG. 7 illustrates shapes of fabric pieces that can be used to form a fabric shell of a slipcover, according to certain embodiments.

FIG. 7 illustrates shapes of fabric pieces that can be used to form a fabric shell 701 of slipcover 600, according to certain embodiments. The fabric shell 701 may include a first piece 704, a second piece 708, and a gusset 706. The first piece 704, the second piece 708, and/or the gusset 706 may be a single continuous piece or may include multiple pieces coupled together (e.g., via stitching). For example, the illustrated example shows that gusset 706 may include a first gusset piece 706*a*, a second gusset piece 706*b*, and a third gusset piece 706*c*. The pieces may have their respective widths measured with respect to the width measurement axis 804 and their lengths measured with respect to the length measurement axis 806.

The first piece 704 may form a top of the slipcover 600. The first piece 704 may be made of any of the materials used to construct the fabric shell 701. The first piece 704 may be U-shaped in geometry. In certain embodiments, the first piece 704 may have a width between about 12 inches to about 19 inches, in some cases from about 14 inches to about 17 inches, and in other cases from about 15 inches to about 16 inches. In certain embodiments, the first piece 704 may have a length between about 20 inches to about 27 inches, in some cases from about 22 inches to about 25 inches, and in other cases from about 23 inches to about 24 inches.

The second piece 708 may form a bottom of the slipcover 600. The second piece 708 may be made of any of the materials the fabric shell 701 is made of. The second piece 708 may include a U-shaped section that corresponds in geometry to the first piece 704. The second piece 708 may include an elongated flap 810 extending from a rear side of the U-shaped section. The elongated flap 810 may be coupled with the first piece 704 and/or the gusset 706. The elongated piece may be coupled to a fastener 712. The fastener 712 may be coupled to the first piece 704. The first piece 704 and the second piece 708 may be positioned such that the first piece 704 and the second piece 708 form an opening along the back of the slipcover 600. The first piece 704 and the elongated flap 810 of the second piece 708 may form an opening along the back of the slipcover 600. The zipper or other fastener 712 may be placed along the opening and may enable the opening to be closed. In certain embodiments, the second piece 708 may have a length between about 20 inches to about 27 inches, in some cases from about 22 inches to about 25 inches, and in other cases from about 23 inches to about 24 inches.

The elongated flap 810 may include a first flap end 812*a* and a second flap end 812*b*. The first flap end 812*a* may be sewn to the gusset 706 (first gusset piece 706*a*). The second flap end 812*b* may be opposite of the first flap end 812*a* and the second flap end 812*b* may be sewn to the gusset 706 (e.g., the third gusset piece 706*c*). The first piece 704 may be sewn to the second piece along the elongated flap 810.

The gusset 706 may be sewn to the first piece 704, the second piece 708, and the elongated flap 810 of the second piece 708. The gusset 706 may be connected (e.g., via stitching) to the first piece 704 and the second piece 708. The gusset 706 may extend around the inner periphery 616 of the support pillow. The gusset 706 may partially (e.g., 50%), mostly (e.g., 60%, 70%, 80%), or completely extend around the outer periphery 618 of the support pillow.

In certain embodiments, the first gusset piece 706*a* and the third gusset piece 706*c* have a length of between about 10 inches to about 16 inches, in some cases from about 11.5 inches to about 14 inches, and in other cases from about 12.5 inches to about 13 inches. The first gusset piece 706*a* and the third gusset piece 706*c* may have a width of between about 1 inch to about 4.5 inches, in some cases from about 2 inches to about 3.5 inches, and in other cases from about 2.5 inches to about 3.0 inches at a first end. The first ends may connect to opposite ends of the elongated end of the second piece 708. The first gusset piece 706*a* and the third gusset piece 706*c* may have a width of between about 0.5 inches to about 3.5 inches, in some cases from about 1 inches to about 2.5 inches, and in other cases from about 1.5 inches to about 2 inches at a second end opposite of the first end. The second end may connect to opposite ends of the second gusset piece 706*b*.

The first gusset piece 706*a* and the third gusset piece 706*c* piece may have the same dimensions or substantially the same dimensions. The second gusset piece 706*b* may have a length between about 30 inches to about 40 inches, in some cases from about 32 inches to about 38 inches, and in other cases from about 33 inches to about 36 inches. The second gusset piece 706*b* may have a width between about 0.5 inches to about 3.5 inches, in some cases from about 1 inch to about 2.5 inches, and in other cases from about 1.5 inches to about 2.0 inches.

In certain embodiments, the first end of the gusset 706 and the second end of the gusset 706 may have a width between about 1 inch to about 5 inches, in some cases from about 2 inches to about 4 inches, and in other cases from about 2.5 inches and 3 inches. In certain embodiments, at least one piece of the gusset may have a tapered shape. In certain embodiments, a center region of the gusset located between the first end of the gusset and the second end of the gusset may have a width about 0.05 inches to about 5 inches, in some cases from about 1 inch to about 4 inches, and in other cases from about 2 inches to about 3 inches. In some embodiments, the gusset has a width that is substantially the same along the length of the gusset. The length of the gusset may be between about 47 inches to about 67 inches, in some cases from about 51 inches to about 63 inches, and in other cases from about 55 inches to about 59 inches.

Figure 8A:
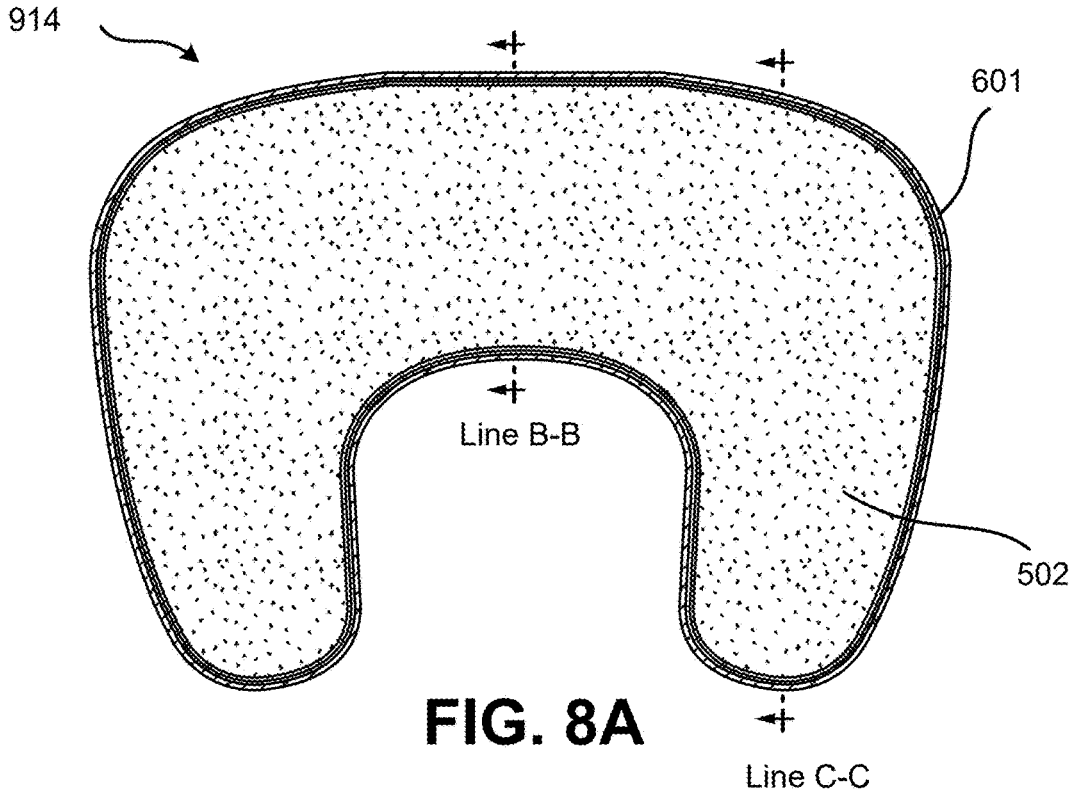
FIGS. 8A-C illustrate cross section views of a slipcover, according to certain embodiments.
Figure 8B:
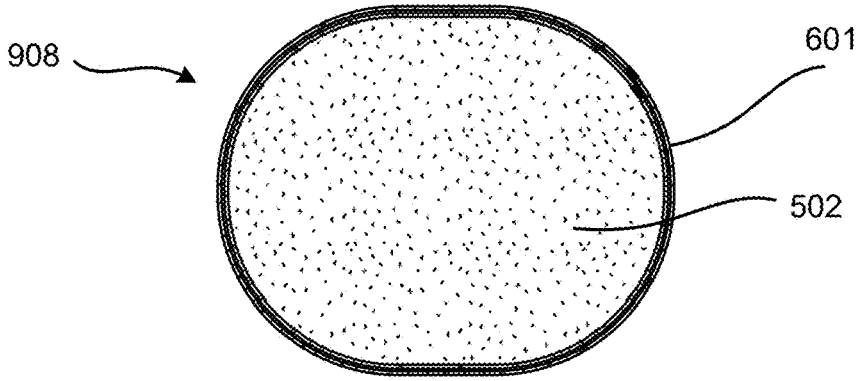
Figure 8C:
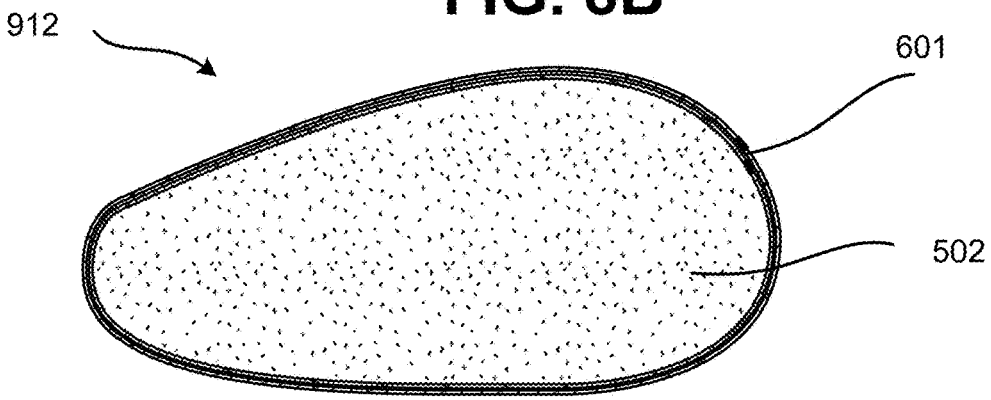

FIGS. 8A-C illustrate cross section views of a slipcover 600 enclosing a support pillow, according to certain embodiments. The cross section views include a second cross section view from a top 914 of the slipcover 600, a third cross section view 908 from a right side of the slipcover 600 and a fourth cross section view from a right side 912 of the slipcover 600. The slipcover 600 may enclose a pillow which may be similar or identical to the support pillows described herein, including support pillow 200.

FIG. 8A illustrates the second cross section view from the top 914 of the slipcover 600. The second cross section view from the top 514 illustrates that the slipcover 600 may enclose a pillow that encloses an amount of fill material 502. The pillow may be enclosed by a fabric shell 701 of the slipcover body 601. When enclosing a pillow, the slipcover 600 may have a firmness where a force of at 706 least 10 Newtons is required to displace a 3-inch diameter hemispheric probe one inch into the fabric shell 701 of the slipcover body 601. In certain embodiments, when enclosing the pillow, slipcover 600 may have a firmness such that the 3-inch diameter hemispheric probe can be pressed against slipcover 600 with up to 10 Newtons of force for at least 30 seconds with the slipcover 600 deflecting by 1 inch or less. For some uses, the firmness of slipcover 600 enclosing the pillow will be greater than the above described firmness, while for other uses, the firmness may be less than the above prescribed firmness.

FIG. 8B illustrates the third cross section view 908 taken along line B-B which is in the medial region 602. As shown, the slipcover medial region 602 may be characterized by an oval shape with flat edges along the top side (e.g., a first piece) and the bottom side (e.g., a second piece). In certain embodiments, the front of the slipcover 600 and the back of the slipcover 600 may additionally or alternatively include a flat edge. The flat front edge may be formed by a gusset.

FIG. 8C illustrates the fourth cross section view taken along line C-C. As illustrated, the slipcover medial region 602 may enclose a greater thickness/height of fill material 502 compared to at a free slipcover end extending from the slipcover medial region 602. The thickness the slipcover 600 is capable of receiving may reduce from the slipcover medial region 602 to the slipcover free end 606. The reduction may be substantially linear.

Figure 9:
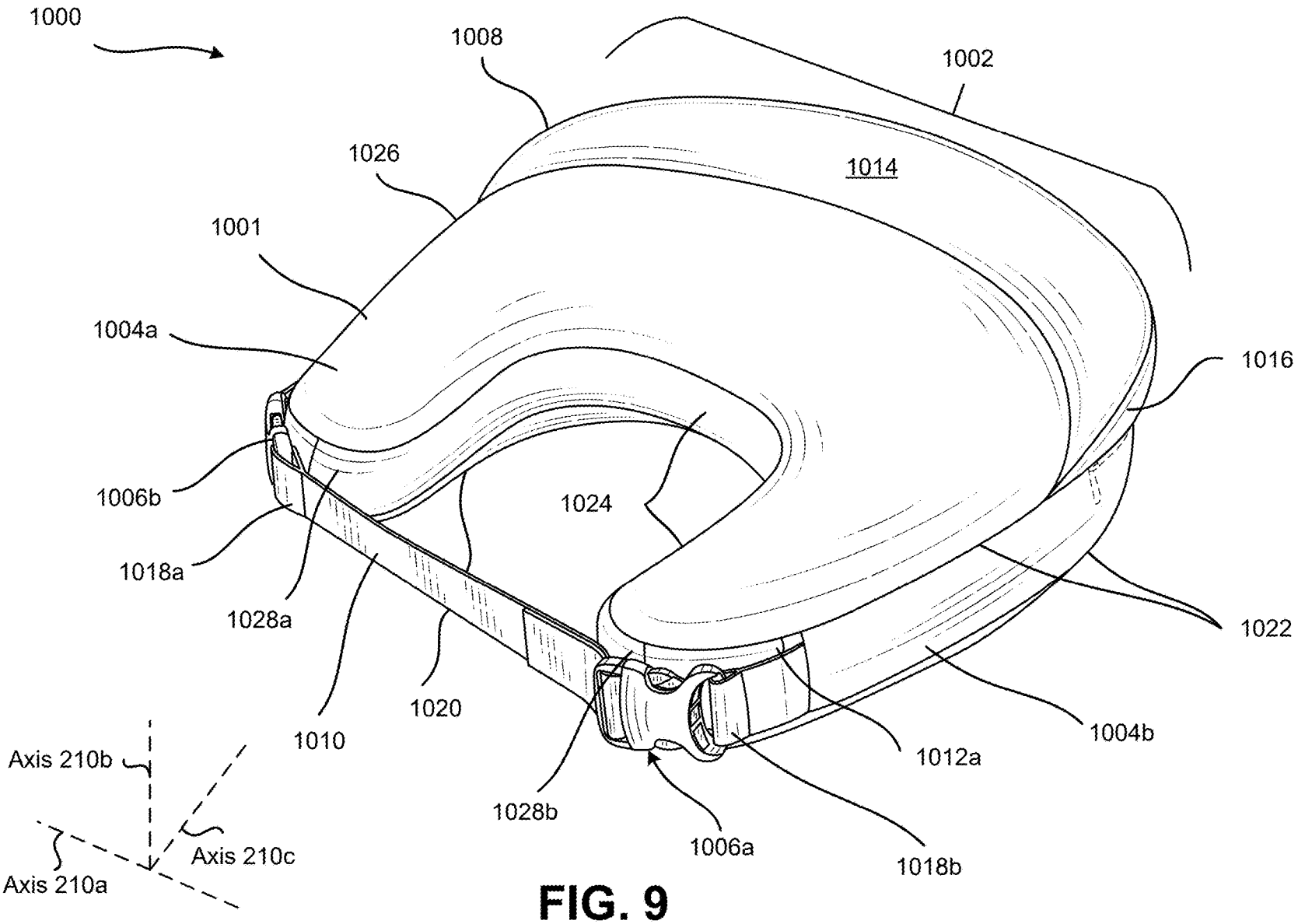
FIG. 9 illustrates a bolstered cover, according to certain embodiments.

FIG. 9 illustrates a bolstered slipcover 1000, according to certain embodiments. The slipcover 1000 may include a bolstered slipcover body 1001. The cover body 1001 may define an open interior adapted to receive a pillow similar to those previously described (e.g., support pillow 200). The slipcover 1000 may include a bolster 1008 at an outer periphery 1026. Slipcover 1000 used in combination with the support pillow may support a baby while nursing and may support a portion (e.g., a head) of the baby higher than other portions of the baby. Slipcover 1000 is shown in the shape when it encompasses a support pillow. The pillow may be similar to any of the pillows described herein The cover body 1001 may have a slipcover medial region 1002, a first slipcover arm 1004*a*, a second slipcover arm 1004*b*, a first free slipcover end 1028*a*, and a second free slipcover end 1028*b*. The first slipcover arm 1004*a* and the second slipcover arm 1004*b* may extend from the slipcover medial region 1002 to define an outer periphery 1026 and an inner periphery 1024. The cover body 1001 may define an open interior that is adapted to receive the pillow. The cover body 1001 may have similar dimensions to a support pillow such that the slipcover 1000 may be placed around the support pillow.

The cover body 1001 defines a vertical axis 210*b* within a curved support cavity about which the cover body 1001 curves. The cover body 1001 also has an outer peripheral edge 1022 and an inner peripheral edge 1020. Slipcover 1000 illustrates the outer peripheral edge 1022 and inner peripheral edge 1020 may both curve about the vertical axis 210*b* defined by the cover body 1001, although in other instances only one of the outer peripheral edge 1022 or inner peripheral edge 1020 may curve about the vertical axis 210*b*. A curvature of the outer peripheral edge 1022 may correlate or correspond with a curvature of the inner peripheral edge 1020. The outer peripheral edge 1022 and/or the inner peripheral edge 1020 may be rounded along axis 210*a* and axis 210*c*.

The slipcover medial region 1002 may be substantially straight (e.g., a center line running less than ten degrees off of axis 210*c*). In certain embodiments, the slipcover medial region 1002 may have a length between about 20 inches to about 27 inches, in some cases from about 22 inches to about 25 inches, and in other cases from about 23 inches to about 24 inches. In certain embodiments, the slipcover 1000 may have a length that is smaller or larger so that it may be placed around other sizes of pillows.

The length of the slipcover medial region 1002 may extend along an axis 210*a* perpendicular to a different axis 210*c* that the first slipcover arm 1004*a* and/or the second slipcover arm 1004*b* extend along. The slipcover medial region 1002 may include rounded edges that curve toward a gusset of the slipcover 1000. In certain embodiments, the slipcover medial region 1002 may be configured to receive a portion of a pillow with a thickness greater than the thickness of the pillow portion the first free slipcover end 1028*a* and/or the second free slipcover end 1028*b* is configured to receive. In certain embodiments, the slipcover medial region 1002 may be configured to receive a portion of a pillow with a thickness substantially the same (e.g., less than 0.5 inches difference) as the thickness of the pillow portion the first free slipcover end 1028*a* and/or the second free slipcover end 1028*b* is configured to receive.

The first slipcover arm 1004*a* and/or the second slipcover arm 1004*b* may be substantially straight. The first slipcover arm 1004*a* may be parallel with respect to the second slipcover arm 1004*b*. The first slipcover arm 1004*a* and/or the second slipcover arm 1004*b* may extend along axis 210*c* and in a direction perpendicular to axis 210*a*. In certain embodiments, the first slipcover arm 1004*a* and/or the second slipcover arm 1004*b* extend between about 5 inches to about 12 inches, in some cases from about 6 inches to about 9 inches, and in other cases from about 7 inches to about 8 inches from the medial region 1002.

The first slipcover arm 1004*a* may include a first free slipcover end 1028*a* opposite of the slipcover medial region 1002 the first slipcover arm 1004*a* extends from. The second slipcover arm 1004*b* may include a second free slipcover end 1028*b* opposite of the slipcover medial region 1002 the second slipcover arm 1004*b* extends from. The first free slipcover end 1028*a* and/or the second free slipcover end 1028*b* may be configured to receive a blunt free pillow end. A distance between the first free slipcover end 1028*a* and the second free slipcover end 1028*b* measured along the axis 210*a* may be at least 8 inches. In certain embodiments, the slipcover 1000 comprises a width between about 13 inches to about 22 inches, in some cases from about 15 inches to about 20 inches, and in other cases from about 17 inches to about 18 inches. The width may be measured along axis 210*c* and may include the combined width of the first slipcover arm 1004*a* and the slipcover medial region 1002 width.

The shape and size of the slipcover 1000 improves a caregiver's ability to properly position an infant or baby while feeding the infant or baby in a safe and efficient manner. The slipcover 1000 is designed to comfortably serve consumers of all body types and infants or babies of all ages. Comfort can be achieved, in part, by the formation of the curved support cavity defined by the inner periphery 1024. The support cavity may define an average radius of curvature of at least between 4.5 inches and 7.5 inches. Comfort can be achieved, in part, by a curved design that conforms to a caregiver's body. The fabric shell 1101 of the slipcover body 1001 may include any material combination of polyester, cotton, polyester microfiber, other microfiber, linen, silk, wool, nylon, rayon, or satin. One having ordinary skill in the art with the benefit of the present disclosure would recognize other materials that may be used in the described embodiments. In certain embodiments, the fabric shell 1101 includes 100% polyester microfiber. The fabric shell 1101 can receive a pillow such as the support pillow described above (e.g., support pillow 200).

The cover body 1001 may include the bolster 1008 at the outer periphery 1026 extending along a majority of the slipcover medial region 1002. The bolster may protrude away from the slipcover medial region 1002. The bolster 1008 may protrude away from the slipcover medial region 1002 in a direction at least partially along axis 210*b*. The back portion 1016 of bolster 1008 may slope backward from the first surface of the slipcover medial region 1002 at an angle in a range from about 90° to about 100° off of axis 210*c*. The front portion 1014 of bolster 1008 may slope backward from the first surface of the slipcover medial region 1002 at an angle in a range from about 35° to about 40° off axis 210*c*. Certain embodiments may include any number of bolsters. Bolsters may be included on the bottom of the cover body 1001 to increase comfort or angling for the user. Bolsters may be included to support different body parts while the pillow is in use.

The slipcover 1000 may include a back portion 1016 and a front portion 1014. The front portion 1014 may be joined (e.g., connected) with a top surface of the cover body 1001 and the back portion 1016 may be joined with the top surface of the cover body 1001. The front portion 1014 may be joined to the front surface via stitching (e.g., sewn). The cover body 1001 may include a seam joining the front portion 1014 and the top surface that has a length between about 20 inches to about 30 inches, in some cases from about 23 inches to about 28 inches, and in other cases from about 25 inches to about 26 inches.

In certain embodiments, the bolster 1008 includes a padding material. The padding material may be any of the padding materials/fill materials described above. The amount of fill material may be such that the bolster 1008 reaches a prescribed firmness where a force of at least 10 Newtons is required to displace a 3-inch diameter hemispheric probe one inch into the fabric shell 1101. In certain embodiments, the bolster may be built into the cover body 1001 as a bolster shell such that the slipcover medial region 1002 can receive a portion of the pillow. When enclosing a pillow, the slipcover may have a firmness where a force of at least 10 Newtons is required to displace a 3-inch diameter hemispheric probe one inch into the fabric shell 1101 of the slipcover body 1001.

In certain embodiments, a strap 1010 may be connected to the slipcover 1000. The strap 1010 may connect to a gusset of the slipcover 1000, the first surface, and/or the second surface. The strap 1010 may include two or more ends. The strap 1010 may be made of material including, but not limited to, nylon, polyester, polypropylene, Cordura, leather, mesh, cotton, wool, rayon, and/or neoprene. The strap 1010 may be configured to detachably connect with the slipcover 1000. The strap 1010 may be configured to detachably connect to at least one of: the outer periphery 1026 of the first slipcover arm 1004*a* or the outer periphery 1026 of the second slipcover arm 1004*b*. The strap 1010 may detachably connect to a connector (e.g., a belt connector 1006). The connector may be connected (e.g., sewn) to the slipcover 1000). The connector may be connected to a connector tab 1018 of the slipcover body 1001.

In certain embodiments, the cover body 1001 includes a pocket 1012. The pocket 1012 may be used to secure the connector and/or at least a portion of the connector tab 1018 when the connector is not connected with a connector of the strap 1010. The pocket 1012 may prevent the connector and/or connector tab(s) 1018 of the slipcover 1000 from being damaged, coming in contact with a user or infant, and/or getting caught on other objects. The pocket 1012 may be one of multiple pockets that are part of the slipcover body 1001. The pocket 1012 may be used to secure other objects (e.g., a bib, bottles, storage bags, etc.). In an example, cover body 1001 includes a pocket 1012*a* along the second bolstered slipcover arm 1004 and a second pocket alone first bolstered slipcover arm 1004*a*. Each of the two pockets may be configured to secure a connector (e.g., a connector of strap 1010) and/or a connector tab 1018.

The pocket 1012 may include an opening running along the gusset. The opening may run along a portion of the gusset width or the full width of the gusset. The pocket 1012 may be located on the outer periphery 1026 of at least one of the arms. For example, the illustrated example shows pocket 1012*a* running along the width of the gusset on the outer periphery 1026 of the second slipcover arm 1004*b*. The pocket 1012*a* includes an opening that at least a portion of the connector tab 1018*b* may be inserted into (e.g., by a user). The pocket 1012*a* includes an opening that the belt connector 1006*a* connected to the connector tab 1018*b* may be inserted into. The connector tab 1018 may be made from a fabric panel and may be configured to withstand at least a 20 pound static load. The connector tab 1018 may also be joined with the gusset.

Figure 10A:
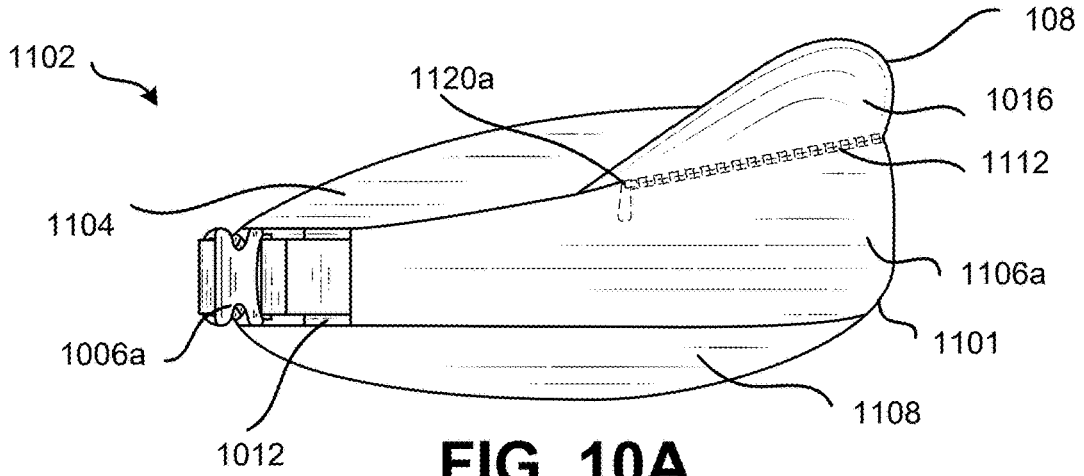
FIGS. 10A-C illustrate different perspective views of a bolstered cover, according to certain embodiments.
Figure 10B:
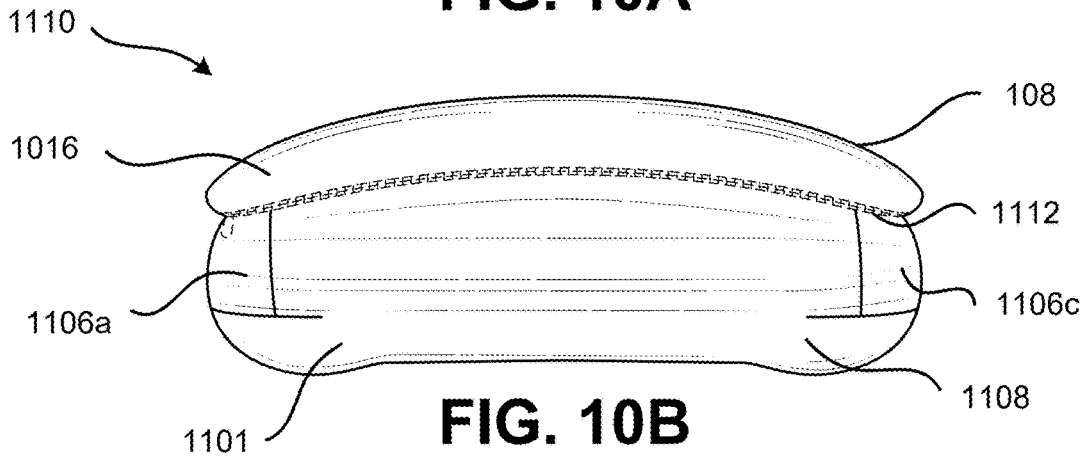
Figure 10C:
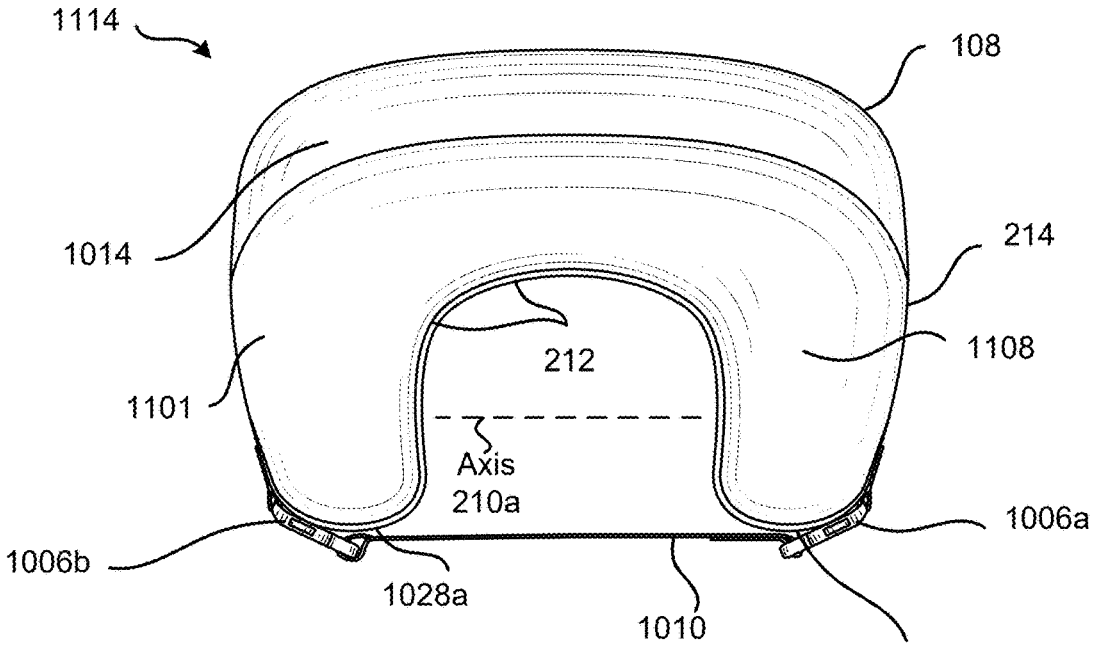

FIGS. 10A-C illustrate different perspective views of bolstered slipcover 1000. The slipcover 1000 may include a fabric shell 1101. The fabric shell 1101 may include a first surface 1104, a gusset 1106, a second surface 1108, fastener, a belt connector 1006*a* or other connector, a pocket 1012, and a bolster 1008. The illustrated slipcover 1000 may enclose a pillow (e.g., support pillow 200).

FIG. 10A illustrates a view from the right side 1102 of the slipcover 1000. The slipcover 1000 may cause the pillow to be oriented in a specific position and firmness based on the shape of the slipcover 1000. The shape of the slipcover 1000 can be defined by the first surface 1104, the second surface 1108, the gusset 1106, and the bolster 1008. In the illustrated example, the gusset 1106 includes three gusset pieces that are connected to form a combined gusset 1106 longer than each of the individual gusset pieces. In certain embodiments, the gusset 1106 is made of a single piece or any number of pieces.

The gusset 1106 may be strips or sections of material that are sewn to the first surface 1104 (e.g., a top piece) and the second surface 1108 (e.g., a bottom piece) of the fabric shell 1101 of the slipcover body 1001. Portions of the gusset 1106 may be sewn to at least a portion of the bolster 1008 (e.g., a back portion of the bolster). In the embodiments where the gusset 1106 includes more than one gusset piece such as a first gusset piece 1106*a*, a second gusset piece 1106*b*, and a third gusset piece 1106*c*, ends of the gusset pieces may be connected together. In certain embodiments, a first gusset piece 1106*a* includes a first end connected to the first surface 1104 and/or second surface 1108. A second end opposite the first end may connect to a first end of the second gusset piece 1106*b*. The second gusset piece 1106*b* may have a second end of the second gusset piece 1106*b* connected to a first gusset end of the third gusset piece 1106*c*. The third gusset piece 1106*c* may include a second end of the third gusset piece 1106*c* opposite the first end of the third gusset piece 1106*c* that is connected to the first surface 1104 and/or the second surface 1108. A first side of the first gusset piece 1106*a*, the second gusset piece 1106*b*, and the third gusset piece 1106*c* that extends between the ends of the respective gusset pieces may connect to the first surface 1104. A second side of the first gusset piece 1106*a*, the second gusset piece 1106*b*, and the third gusset piece 1106*c* opposite the side of the first side and extending between the ends of the respective gusset pieces may connect to the second surface 1108.

The gusset 1106, the first surface 1104, the second surface 1108, and/or the bolster 1008 may be connected by seams. Seams may be formed where fabric pieces are connected (e.g., where the gusset 1106 is sewn to the first surface 1104 and the second surface 1108). In certain embodiments, the seams may be configured to withstand at least 15 pounds of tension force. The gusset 1106 may extend along a midplane of the cover body 1001. The gusset 1106 may extend around the inner periphery 1024 and the outer periphery 1026 of the slipcover body 1001. The gusset 1106 may have ends with respective edges that are sewn to the second surface 1108. The end of the gusset 1106 may be sewn to the second surface 1108 at the back of the slipcover body 1001. In certain embodiments, the entire width or substantially all of the width of the gusset end is sewn to the second surface 1108. The width of the gusset 1106 between the gusset ends may be constant or may taper (e.g., have a width of about 3 inches at the gusset ends and a width of about 2 inches near the middle). In certain embodiments, the width of a gusset piece is smallest near the middle of the gusset piece between the gusset ends. Different gusset pieces that form the gusset 1106 may have different dimensions than one or more of the other gusset pieces that form the gusset 1106.

The bolster 1008 may be formed by at least a back portion 1016 and a front portion 1014 being joined. The front portion 1014 may be joined with the first surface 1104 and the back portion 1016. The front portion 1014 may be joined with the first surface 1104 by a seam with a length between about 20 inches to about 30 inches, in some cases from about 23 inches to about 28 inches, and in other cases from about 25 inches to about 26 inches in length. The center of the front portion 1014 of the bolster 1008 may be between about 1 inch to about 4 inches, in some cases from about 1.5 inches to about 3 inches, and in other cases from about 2 inches to about 2.5 inches. The back portion 1016 may be joined with at least a portion of the second surface 1108 and/or the gusset 1106.

The first surface 1104 may be joined with a fastener 1112 (e.g., a zipper). The fastener 1112 may be configured in a similar way to the fasteners described herein above (e.g., fastener 712). The fastener 1112 may be positioned along an opening. The fastener 1112 can be joined with the first surface 1104 and the second surface 1108 using a seam stitched with double back stitching. The opening may be an opening between the first surface 1104 and the second surface 1108. The opening may be between the second surface 1108 and the back portion 1016 of the bolster 1008. The opening may have opening ends 1120 spaced between about 24 inches to about 32 inches, in some cases from about 26 inches to about 30 inches, and in other cases from about 27.5 inches to about 28.5 inches apart. The fastener 1112 may be configured to close and/or open the opening through which the pillow is insertable.

FIG. 10B illustrates a view from the back 1110 of the slipcover 1000. From the view from the back 1110 of the slipcover 1000, the fastener 1112 may be seen. The fastener

1112 may include a zipper, a button, stitching, and/or hook and loop fasteners. The fastener 1112 may be configured to open and close the opening between the first surface 1104 and the second surface 1108. The fastener 1112 may be located along the opening. The fastener 1112 may be located along portions of the opening or along all of the opening. The opening may have two opening ends 1120. The fastener 1112 may be located on the interior of the slipcover body 1001 or the exterior of the slipcover body 1001. In certain embodiments, the fastener 1112 is preferred to be placed on the inside (the side facing an inserted pillow) of the slipcover body 1001. In certain embodiments, the fastener 1112 is preferred to be placed on the outside of the slipcover body 1001 to improve the ease of access to the fastener 1112 by a user. The fastener 1112 may be connected to the first surface 1104, the second surface 1108, the bolster 1008, or the gusset 1106 via stitching.

The opening ends 1120 may have any number of back-stitches over a seam joining the first surface 1104 and the second surface 1108. In certain embodiments, two or more back stitches are used. The back stitches may be used to prevent the opening from tearing and becoming bigger during insertions and removal of a pillow from/to the slipcover 1000. A fabric brace may be used in addition to or as an alternative to the back stitches. A fabric brace may be placed on the inside of the fabric shell 1101 (the side with the inserted pillow) and stitched to the first surface 1104 and the second surface 1108. The fabric brace may be included at one or both opening ends 1120. In certain embodiments, the fastener 1112 is coupled to an elongated flap of the second surface (e.g., described further with respect to FIG. 12). The ends of the fastener 1112 may be at the outer periphery 1026 of the slipcover.

FIG. 10C illustrates a view from the top 1114 of the slipcover 1000. As illustrated by the view from the top 1114, the inner peripheral edge 1020 of the slipcover 1000 includes a gusset 1106 that is coupled along a vertical midsection of the inner peripheral edge 1020 and that extends about or around the curved support cavity of the slipcover 1000. The gusset 1106 is adapted to prevent tearing of the slipcover 1000 adjacent to the inner peripheral edge 1020 of the curved support cavity during use, such as upon movement or deflection of the slipcover 1000 (e.g., while enclosing a pillow). A gusset piece (e.g., the second gusset piece 1106*b*) may extend about the curved support cavity. Further, the third gusset piece 1106*c* and the first gusset piece 1106*a* may extend around most of the outer periphery 1026 of the slipcover body 1001.

The first bolstered slipcover arm 1004*a* and the second bolstered slipcover arm 1004*b* may extend in the range from about 5 inches to about 12 inches, in some cases from about 6 inches to about 10 inches, and in other cases from about 7 inches and 8 inches. The extension of the slipcover arms 1004 may be measured in a similar fashion as the first pillow arm 204*a* and the second pillow arm 204*b* as described above. For example, the slipcover arm 1004 length may be measured from a free slipcover end of a respective slipcover arm 1004 to a middle portion of the inner periphery 1024 and/or front center portion of the slipcover medial region 1002.

The bolster 1008 typically has an arcuate or curved shape corresponding to the arcuate or curved shape of the slipcover body 1001. More specifically, the curve of the bolster 1008 may be the same as the curve of the outer peripheral edge 1022 and/or back of the first surface 1104. The bolster 1008 may extend along a majority a length of the slipcover body 1001 along an axis 210. In some embodiments, the bolster 1008 could extend along between 60 and 90 percent of this length, between 65 to 85 percent of this length, or between 70 and 80 percent of this length. In some instances, the bolster 1008 may extend along the entire length of the slipcover body 1001.

Figure 11:
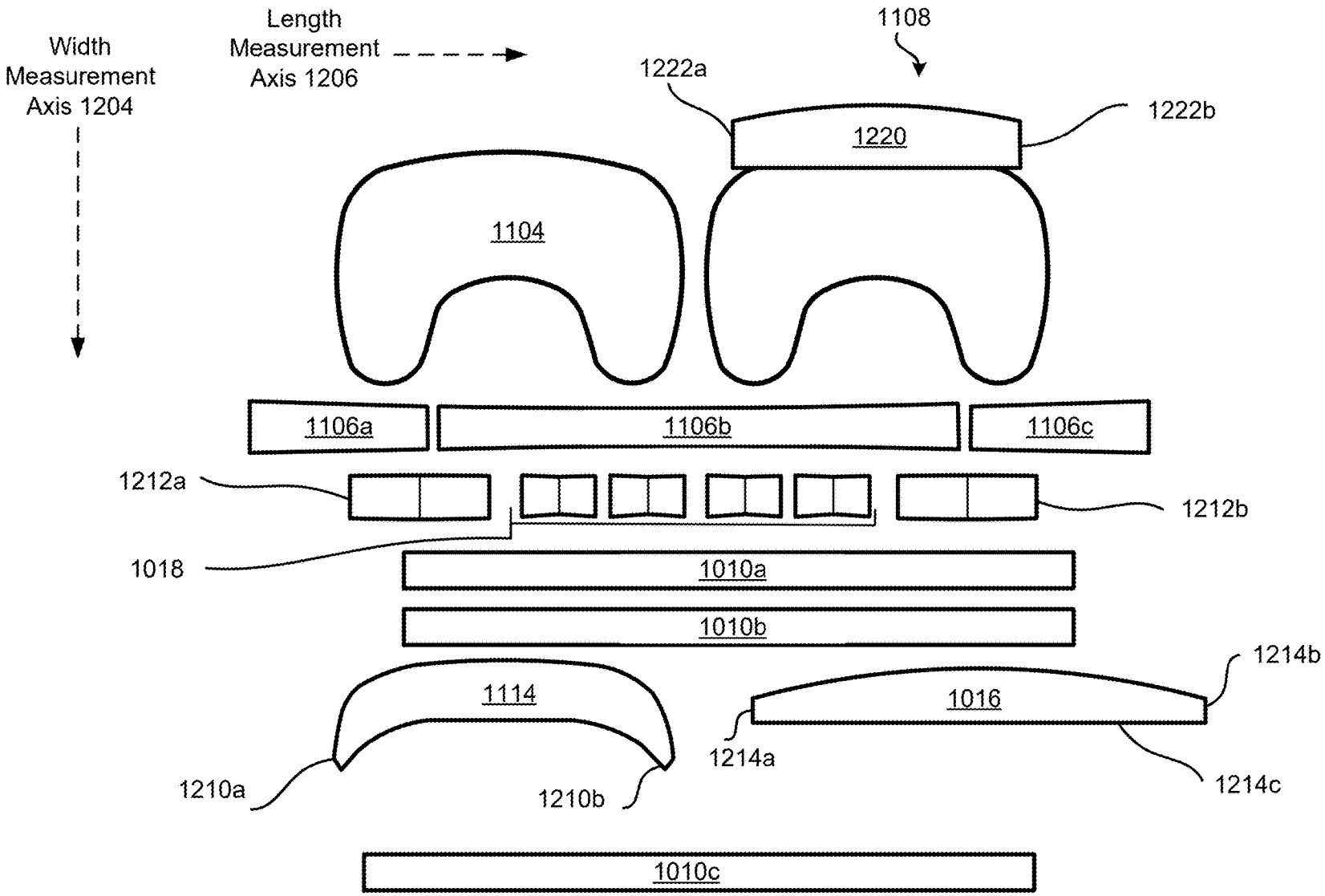
FIG. 11 illustrates shapes of fabric pieces that can be used to form a fabric shell of a bolstered cover, according to certain embodiments.

FIG. 11 illustrates shapes of fabric pieces that can be used to form fabric shell 1101 of a bolstered slipcover 1000, according to certain embodiments. The fabric shell 1101 may include a first surface 1104, a second surface 1108, and a gusset 1106. The fabric shell 1101 may additionally include pockets made from pocket pieces 1212, connector tabs 1018, a bolster including a front portion 1014 and a back portion 1016. The fabric shell 1101 may be connected to one or more straps 1010. Any of the surfaces or pieces described herein may be continuous or may include multiple pieces coupled together (e.g., via stitching). For example, the illustrated example shows that gusset 1106 may include a first gusset piece 1106*a*, a second gusset piece 1106*b*, and a third gusset piece 1106*c*. The surfaces or pieces may have their respective widths measured with respect to the width measurement axis 1204 and their lengths measured with respect to the length measurement axis 1206.

The first surface 1104 may form a top of the slipcover 1000. The first surface 1104 may be made of any of the materials the fabric shell 1101 is made of. The first surface 1104 may be U-shaped in geometry. In certain embodiments, the first surface 1104 may have a first surface width between about 14 inches to about 21 inches, in some cases from about 16 inches to about 19 inches, and in other cases from about 17 inches to about 18 inches. In certain embodiments, the first surface may have a first surface length between about 20 inches to about 27 inches, in some cases from about 22 inches to about 25 inches, and in other cases from about 23 inches to about 24 inches.

The second surface 1108 form a bottom of the slipcover 1000. The second surface 1108 may be made of any of the materials the fabric shell 1101 is made of. The second surface 1108 may include a U-shaped section that corresponds in geometry to the first surface 1104. The second surface 1108 may include an elongated flap 1220 extending from a rear side of the U-shaped section. The elongated flap 1220 may be coupled with the first surface 1104, the gusset 1106, and or the bolster (e.g., the back portion 1016 of the bolster 1008). The elongated flap 1220 may be coupled to a fastener. The fastener may be coupled to the first surface 1104. The first surface 1104 and the second surface 1108 may be positioned such that the first surface 1104 and the second surface 1108 form an opening along the back of the slipcover 1000. The first surface 1104 and the elongated flap 1220 of the second surface 1108 may form an opening along the back of the slipcover 1000. A zipper or other fastener may be placed along the opening and may enable the opening to be closed and/or opened.

The elongated flap 1220 may include a first flap end 1222*a* and a second flap end 1222*b*. The first flap end 1222*a* may be sewn to the gusset 1106 (e.g., first gusset piece 1106*a*). The second flap end 1222*b* may be opposite of the first flap end 1222*a* and the second flap end 1222*b* may be sewn to the gusset 1106 (e.g., the third gusset piece 1106*c*). The first surface 1104 may be sewn to the second surface 1108 along the elongated flap 1220.

The gusset 1106 may be sewn to the first surface 1104, the second surface 1108, and the elongated flap 12220 of the second surface 1108. The gusset 1106 may be connected (e.g., via stitching) to the first surface 1104 and the second surface 1108. The gusset 1106 may extend around the inner periphery 1024 of the slipcover body 1001. The gusset 1106 may partially (e.g., 50%), mostly (e.g., 60%, 70%, 80%), or completely extend around the outer periphery 1026 of the slipcover body 1001.

In certain embodiments, the first gusset piece 1106*a* and the third gusset piece 1106*c* have a length of between about 9 inches to about 16 inches, in some cases from about 11 inches to about 14 inches, and in other cases from about 12 inches to about 13 inches. The first gusset piece 1106*a* and the third gusset piece 1106*c* may have a width at a first end between about 0.5 inches to about 5.5 inches, in some cases from about 1.5 inches to about 4.5 inches, and in other cases from about 2.5 inches to about 3.5 inches. The first ends may connect to opposite ends of the elongated end of the second surface 1108. The first gusset piece 1106*a* and the third gusset piece 1106*c* may have a width at a second end opposite of the first end between about 0.5 inches to about 3.5 inches, in some cases from about 1 inch to about 2.5 inches, and in other cases from about 1.5 inches to about 2 inches. The second end may connect to opposite ends of the second gusset piece 1106*b*. The first gusset piece 1106*a* and the third gusset piece 1106*c* may have the same dimensions or substantially the same dimensions. The second gusset piece 1106*b* may have a length between about 29 inches to about 40 inches, in some cases from about 31 inches to about 38 inches, and in other cases from about 33 inches to about 36 inches. The second gusset piece 1106*b* may have a width between about 0.5 inches to about 3.5 inches, in some cases from about 1 inch to about 2.5 inches, and in other cases from about 1.5 inches to about 2 inches.

In certain embodiments, the first end of the gusset 1106 and the second end of the gusset 1106 may have a width between about 0.5 inches to about 5.5 inches, in some cases from about 1.5 inches to about 4.5 inches, and in other cases from about 2.5 inches to about 3.5 inches. In certain embodiments, at least one piece of the gusset 1106 may have a tapered shape. In certain embodiments, a center region of the gusset 1106 located between the first end of the gusset 1106 and the second end of the gusset 1106 may have a width about 0.5 inches to about 5 inches, in some cases from about 1 inch to about 3.5 inches, and in other cases from about 1.5 inches to about 2.5 inches. In some embodiments, the gusset 1106 has a width that is substantially consistent along the length of the gusset 1106. The length of the gusset 1106 may be between about 47 inches to about 67 inches, in some cases from about 51 inches to about 63 inches, and in other cases from about 55 inches to about 59 inches.

Any number of pockets and pocket pieces 1212 may be included in the fabric shell 1101. In the illustrated embodiments, two pocket pieces 1212 and pockets are shown. The pocket pieces 1212 may be configured as described above. The pocket pieces 1212 may be sewn to the fabric shell 1101. A pocket piece 1212 may be joined to the outer periphery 1026 of the arm 1004 of the slipcover 1000. The pocket 1012 may be formed by joining edges of the pocket piece 1212 with the fabric shell 1101. The pocket piece 1212 may have an edge that is not joined with the fabric shell 1101 such that an opening to the pocket is created. The pocket 1012 may be configured such that connectors or other items are capable of being stored within the space within the pocket.

In certain embodiments, the pocket piece 1212 may have a length between about 6.5 inches to about 11.5 inches, in some cases from about 7.5 inches to about 10.5 inches, and in other cases from about 8.5 inches to about 9.5 inches. The pocket piece 1212 may be folded in mostly equal halves so the length of each half is between about 3 inches to about 6 inches, in some cases from about 4 inches to about 5 inches, and in other cases from about 4.25 inches to about 4.75 inches. In certain embodiments, the pocket piece 1212 is not folded in half and is between about 3 inches to about 6 inches, in some cases from about 4 inches to about 5 inches, and in other cases from about 4.25 inches to about 4.75 inches. The pocket piece may be sewn to the fabric shell 1101 such that the pocket piece 1212 in combination with the fabric shell 1101 forms a pocket with an opening. In certain embodiments, the narrow edge of the pocket piece 1212 may have a width between about 0.5 inches to about 4 inches, in some cases from about 1 inches to about 3 inches, and in other cases from about 1.5 inches to about 2.5 inches.

The connector tabs 1018 may be joined with the fabric shell 1101 and a connector (e.g., a belt connector). The connector tabs 1018 may have a length between about 2.5 inches to about 6.5 inches, in some cases from about 2.5 inches to about 5.5 inches, and in other cases from about 3.5 inches to about 4.5 inches. A connector tab 1018 may be passed through the connector such that the connector tab remains movement bound by the connector tab 1018. The ends of the connector tab 1018 may be joined to the fabric shell 1101. The fabric shell 1101 and/or the connector may be configured to withstand at least a 10, 20, or 30 pound static load.

The bolster may include the front portion 1014 and the back portion 1016. The front portion 1014 may be joined with the first surface 1104. The front portion 1014 may be U-shaped in geometry. The front portion 1014 may include a first narrowing end 1210*a* and a second narrowing end 1210*b*. The first narrowing end 1210*a* may be joined with the fabric shell 1101 in a portion such that the first narrowing end 1210*a* is closer to a first arm 1004*a* than a second arm 1004*b* of the slipcover 1000. The second narrowing end 1210*b* may be opposite of the first narrowing end 1210*a*. The second narrowing end 1210*b* may be joined with the fabric shell 1101 in a portion such that the second narrowing end 1210*b* is closer to the second arm 1004*b* than the first arm 1004*a* of the slipcover 1000. The front portion 1014 may include a center portion between the first narrowing end 1210*a* and the second narrowing end 1210*b* with a width between about 1 inch to about 6 inches, in some cases from about 2 inches to about 5 inches, and in other cases from 3 inches to about 4 inches. The front portion 1014 may be joined with the first surface 1104 by a seam with a length between about 20 inches to about 31 inches, in some cases from about 23 inches to about 28 inches, and in other cases from about 25.00 inches to about 26.00 inches. The front portion 1014 may be joined with the first surface 1104 along the concave shaped portion of the front portion.

The back portion 1016 may be joined with the front portion 1014, the first surface 1104 and/or with a fastener. The back portion 1016 may include a first edge 1214*a* and a second edge 1214*b* of substantially the same length spanning the width of the back portion 1016. The back portion 1016 may include a third edge 1214*c* running between the first edge 1214*a* and the second edge 1214*b*. The third edge 1214*c* may be joined to the front portion 1014, the first surface 1104 and/or with a fastener. The third edge 1214*c* may have a length between about 18 inches to about 32 inches, in some cases from about 20 inches to about 30 inches, and in other cases from about 22 to about 28 inches long. In certain embodiments, the third edge 1214*c* has a length between about 21 inches to about 30 inches, in some cases from about 24 inches to about 27 inches, and in other cases from about 25 inches to about 26 inches. The back portion 1016 may include a fourth edge opposite the third edge 1214*c*. The fourth edge may be opposite the third edge 1214*c* by between about 1 inches to about 4.5 inches, in some cases from about 2 inches to about 3.5 inches, and in other cases from about 2.55 inches to about 3 inches.

In other words, the back portion 1016 may have a width along the first edge 1214*a* the second edge 1214*b* of around about 1 inch to about 5 inches, in some cases from about 1.5 inches to about 4 inches, and in other cases from about 2 inches to about 3 inches. The back portion 1016 may have a width near the center of the length of the back portion 1016 of the back portion of about 1 inch to about 6 inches, in some cases from about 2 inches to about 5 inches, and in other cases from about 3 to about 4 inches. The fourth edge may be coupled with the front portion 1014. The first edge 1214*a* and the second edge 1214*b* may have substantially the same length between about 1 inch to about 5.5 inches, in some cases from about 1.5 inches to about 4.5 inches, and in other cases from about 2.50 inches to about 3.5 inches. The bolster may be configured to enclose an amount of a fill material that provides substantially all of the bolster placed about the fill material with a prescribed firmness where a force of at least 10 Newtons is required to displace a 3-inch diameter hemispheric probe one inch into the bolster placed about the fill material. In certain embodiments, bolster may have a firmness such that the 3-inch diameter hemispheric probe can be pressed against bolster with up to 10 Newtons of force for at least 30 seconds with the bolster deflecting by 1 inch or less. For some uses, the firmness of the bolster will be greater than the above described firmness, while for other uses, the firmness may be less than the above prescribed firmness.

The slipcover 1000 may include any number of straps 1010 (e.g., zero or more). A strap 1010 may have a width between 1.4 inches and 1.9 inches. The strap 1010 may have a length between about 41 inches to about 53 inches, in some cases from about 44 inches to about 50 inches, and in other cases from about 46 inches to about 48 inches. The strap 1010 may include a belt stop snapper. The belt stop snapper can limit the length that the strap 1010 can be tightened and prevents the first free end 1028*a* of the first slipcover arm 1004*a* and the second free end 1028*b* of the second slipcover arm 1004*b* from touching. In certain embodiments, the belt stop snapper is included between about 9 inches to about 17 inches from an end of the strap 1010, in some cases from about 11 inches to about 15 inches from an end of the strap 1010, and in other cases from about 12.5 inches to about 13.5 inches from an end of the strap 1010. The belt stop snapper may include a material with a thickness greater than the thickness allowed to pass through an opening the strap 1010 passes through. The opening may be included in the connector (e.g., belt connector).

Figure 12A:
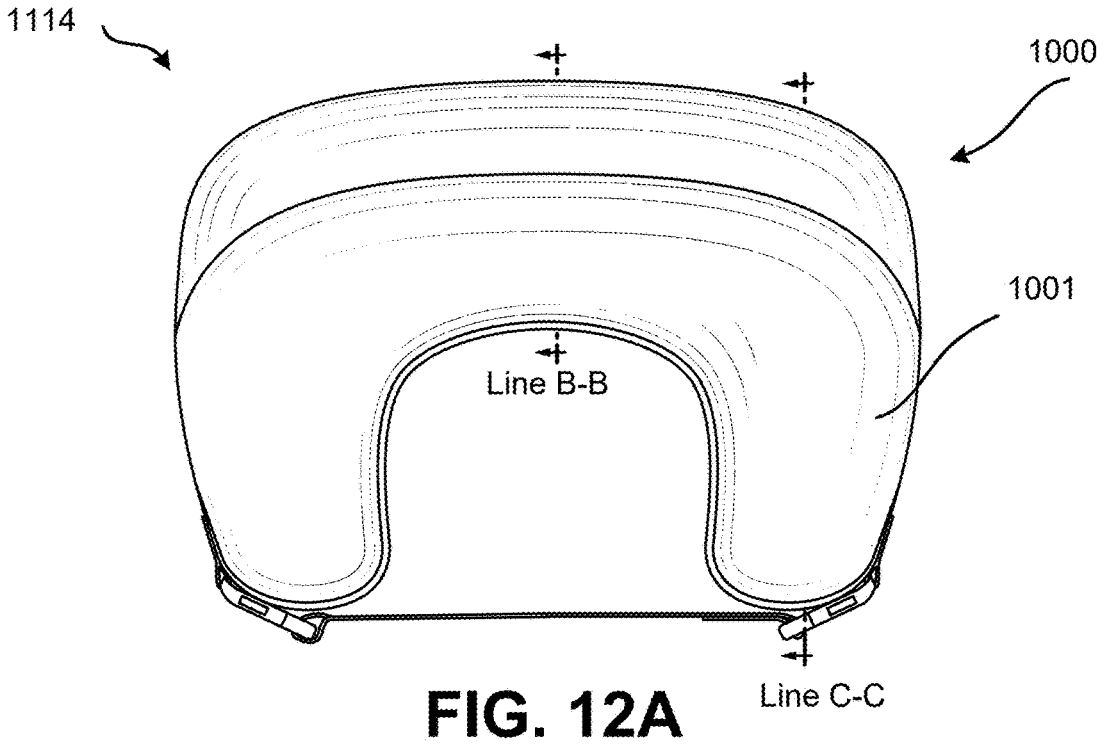
FIGS. 12A-C illustrate cross section views of a bolstered cover, according to certain embodiments.
Figure 12B:
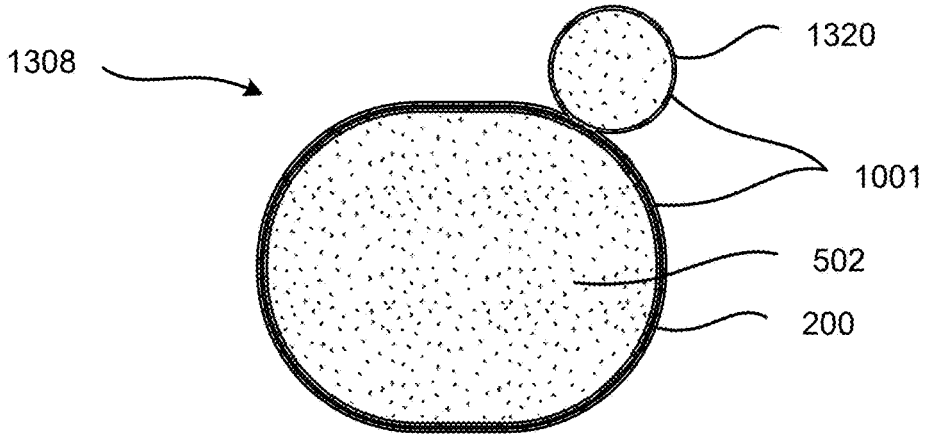
Figure 12C:
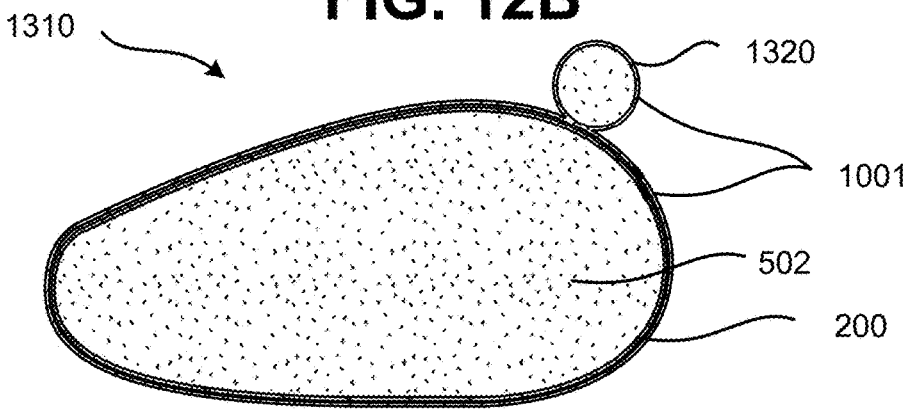

FIGS. 12A-C illustrate different views of the bolstered slipcover 1000, according to certain embodiments. FIG. 12A illustrates a view from the top 1114 of the slipcover 1000. FIGS. 12B and 12C illustrates cross section views of the slipcover 1000. The cross section views include a fifth cross section view from a right side 1308 of the slipcover 1000 and a sixth cross section view 1310 from a right side of the slipcover 1000. The slipcover 1000 is illustrated as enclosing a pillow (e.g., support pillow 200).

FIG. 12A illustrates the view from the top 1114 of the slipcover 1000. The view from the top 1114 of the slipcover 1000 illustrates that the slipcover 1000 may enclose the support pillow 200 that encloses an amount of fill material 502. The support pillow 200 may be enclosed by a fabric shell of the slipcover 1000. When enclosing a support pillow 200, the slipcover 1000 may have a firmness where a force of at least 10 Newtons is required to displace a 3-inch diameter hemispheric probe one inch into the fabric shell of the slipcover body 1001. The view from the top 1114 of the slipcover 1000 illustrates a fifth cross section 1308 across a slipcover medial region 1002 of the slipcover 1000 and a sixth cross section 1310 across a combination of the slipcover medial region 1002 and a slipcover arm 1004 of the slipcover 1000. The cross sections are described further below.

FIG. 12B illustrates the fifth cross section view 1308 of the slipcover 1000 enclosing the support pillow 200 taken along line B-B. The fifth cross section view 1308 may be produced by viewing the slipcover 1000 from the right side based on a cross section along line B-B. The fifth cross section view 1308 illustrates that the slipcover medial region 1002 may be characterized by an oval shape with flat edges along the top side (e.g., a first piece) and the bottom side (e.g., a second piece). In certain embodiments, the front of the slipcover 1000 and the back of the slipcover 1000 illustrated by the fifth cross section view 1308 may additionally or alternatively include a flat edge. The flat front edge may be formed by a gusset.

The fifth cross section view 1308 further illustrates the bolster. The bolster may have a cross sectional circular portion perimeter. The cross sectional circular portion perimeter of the bolster may be between about 1.5 inches to about 5.5 inches, in some cases from about 1.5 inches to about 4.5 inches, and in other cases from about 2.5 inches to about 3.5 inches. The bolster is illustrated as including a volume of fill material 502 that is distinct from the volume of space the slipcover 1000 may receive the support pillow 200 into. In such embodiments, the fill material 502 of the bolster may be the same or different type of fill material 502 than used by the support pillow 200. The bolster may be filled such that the firmness of the bolster is the same or different firmness as the support pillow 200. In certain embodiments, the bolster may be configured to receive a portion of the support pillow 200 received by the slipcover body 1001.

FIG. 12C illustrates the sixth cross section view 1310 of the slipcover 1000 that encloses the support pillow 200 taken along line C-C. The sixth cross section view 1310 may be produced by viewing the slipcover 1000 enclosing the support pillow 200 from the right side based on the position of line C-C. The sixth cross section view 1310 illustrates that the slipcover medial region 1002 may enclose a greater thickness/height of fill material 502 compared to at a free slipcover end 1028 extending from the slipcover medial region 1002. The support pillow 200 thickness the slipcover 1000 is capable of receiving may reduce from the slipcover medial region 1002 to the free slipcover end 1028. The reduction may be substantially linear.

FIGS. 12B and 12C also illustrate that between the fifth cross section view 1308 and the sixth cross section view 1310, the cross sectional area of the bolster may reduce closer to the ends of the bolster. In other words, the cross sectional circular perimeter of the bolster may be smaller near the end of the bolster than near the center of the bolster. The bolster may have a conical shape at opposing ends of the bolster. The conical shape may be caused by the tapering of the bolster near the ends of the bolster. The bolster may include a gradual transition between a central portion of the bolster and/or slipcover body 1001 and an end of the bolster.

Figure 13:
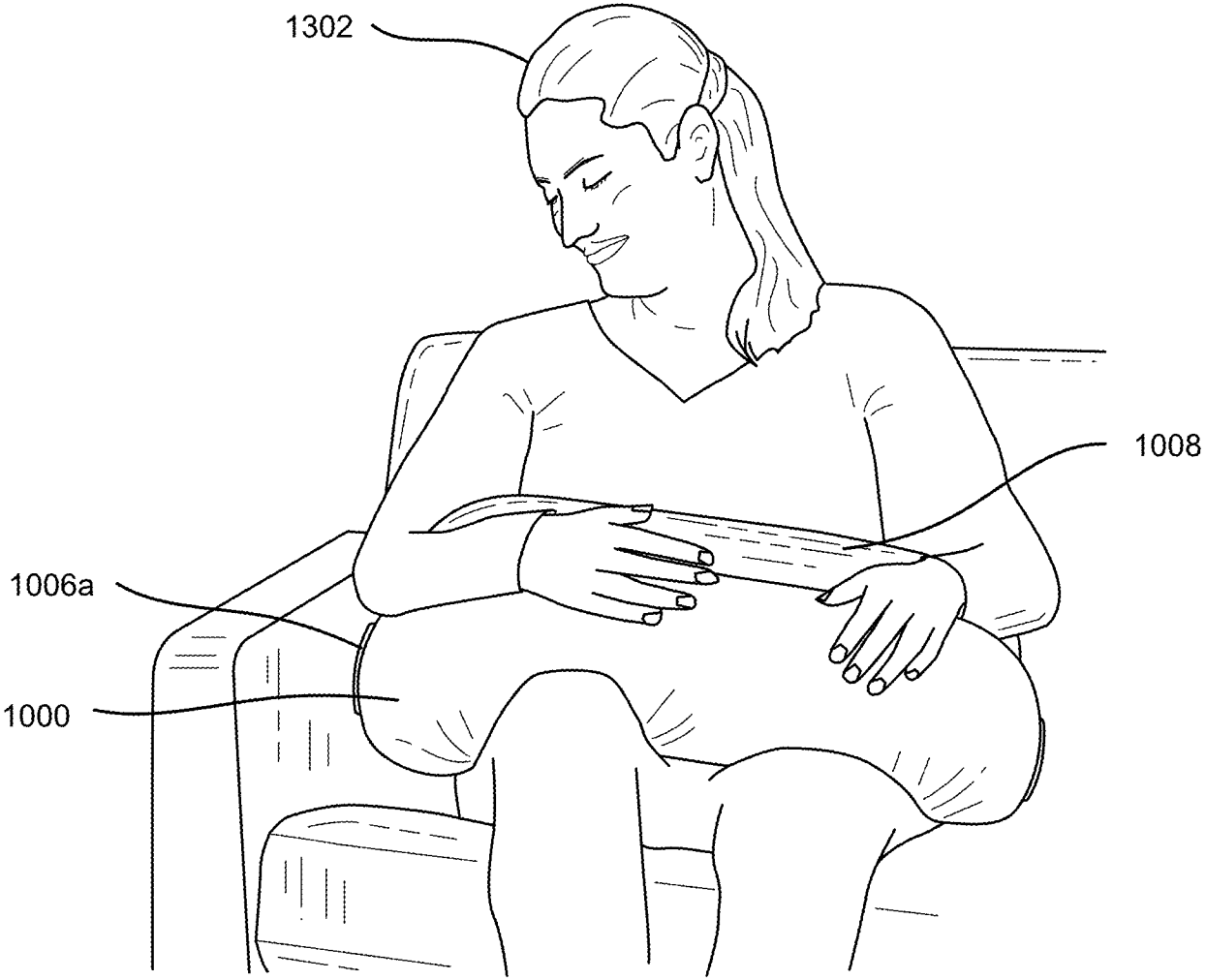
FIG. 13 illustrates a bolstered slipcover enclosing a support pillow being used by a user, according to certain embodiments.

FIG. 13 illustrates a bolstered slipcover 1000 enclosing a support pillow being used by a user 1302, according to certain embodiments. As shown, the slipcover 1000 encloses the support pillow, thus hiding it from view. Although useful with a wide variety of pillows, one embodiment of such a support pillow is described with respect to FIG. 2. Although the pillow is shown as enclosed by a bolstered slipcover 1000, the description also applies to the use of a support pillow with a different slipcover (e.g., slipcover 600) or without any slipcover.

Slipcover 1000 is depicted on a lap of the user 1302. Slipcover 1000 may be secured around the waist of the user 1302 via a strap/belt that is connected to one or more belt connectors 1006 (e.g., belt connector 1006*a*). The user 1302 is shown seated, with the slipcover 1000 on their lap and a strap connected to arms 1004 of the slipcover 1000 and running around the waist of the user 1302. A support cavity of the inner periphery 1024 of the slipcover 1000 may be positioned around at least a portion of the user 1302. The support cavity may be in contact with the torso of user 1302. The slipcover 1000 may support a baby while nursing, feeding or the like. In so doing, the slipcover 1000—may be used to support a portion (e.g., a head) of the baby higher than other portions of the baby.

The shape of the pillow and slipcover 1000 may fit most users of a variety of sizes and shapes. In use, the user 1302 may initially position slipcover 1000 to support the baby but desire to have the baby's head at a higher or lower height for ease of nursing the baby. The user 1302 may rotate the slipcover 1000 around their torso until the thickness of the slipcover 1000 provides a desired height for nursing the baby.

In use, portions of the slipcover 1000 may curve around the front and side of the user 1302 and provides support for an arm, elbow, or hand of the user 1302. In some examples, the slipcover 1000 may be positioned in other arrangements around the user 1302 to provide support to different parts of the user 1302 and/or the baby. In certain embodiments, a slipcover without a bolster encloses the support pillow. In certain embodiments, a pillow (e.g., without a slipcover, with or without a bolster) may be used by the user 1302.

The pillows described herein may be manufactured by joining pieces and/or portions of fabric together to form a fabric shell. The fabric shell may include an opening which a nozzle is capable of being inserted into. The nozzle may blow fill material into the fabric shell. The opening may then be closed (e.g., using a fastener and/or stitching). The fastener may be configured to enable the opening to be subsequently opened and closed again. In certain embodiments, the fastener may be configured to prevent the opening from being subsequently opened.

The slipcovers described herein may be manufactured by joining pieces and/or portions of fabric together to form a fabric shell. The joining may be performed using stitching, braces, backstitching, etc. The fabric shell may be configured to receive a pillow such as any of the pillows described herein.

A bolster, such as the bolster that may be included in the bolstered slipcover may be manufactured by joining pieces and/or portions of fabric together to form a fabric shell, the fabric shell may define an interior. The interior may include a portion corresponding to the bolster. The portion of the interior corresponding to the bolster may have fill material inserted into it (e.g., blown into it using a nozzle, or by hand) before the portion of the interior corresponding to the bolster is closed off from the other portion(s) of the interior. Closing off the portion of the interior corresponding to the bolster may result in a bolster that includes fill material and a remaining open interior that can receive a pillow.

In certain embodiments, a slipcover without a bolster is formed by joining the fabric surfaces and/or pieces together and the bolster formed separately before being joined with the slipcover to create the bolstered slipcover. The bolster may be filled through an end or other opening before or after being joined with the slipcover. In certain embodiments, the bolster is filled, sealed, and then joined with a slipcover to create the bolstered slipcover.

Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of steps may be undertaken before, during, or after the above elements are considered.

Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the disclosure to the specific form or forms disclosed, but on the contrary, the intention is to cover all modifications, alternative constructions, and equivalents falling within the spirit and scope of the disclosure, as defined in the appended claims.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the disclosure and does not pose a limitation on the scope of the disclosure unless otherwise claimed. No language in the specification should be construed as indicating any non-claimed element as essential to the practice of the disclosure.

Disjunctive language such as the phrase "at least one of X, Y, or Z," unless specifically stated otherwise, is intended to be understood within the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Preferred embodiments of this disclosure are described herein, including the best mode known to the inventors for carrying out the disclosure. Variations of those preferred embodiments may become apparent to those of ordinary skill in the art upon reading the foregoing description. The inventors expect skilled artisans to employ such variations as appropriate and the inventors intend for the disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A support pillow comprising:

a pillow body comprising:

a substantially straight medial region;

a substantially straight first arm extending from the substantially straight medial region and having a first free end;

a substantially straight second arm extending from the substantially straight medial region and having a second free end;

wherein a distance between the first free end and the second free end is at least 8 inches;

wherein the substantially straight first arm, the substantially straight medial region, and the substantially straight second arm define an outer periphery and an inner periphery; and wherein the inner periphery defines a curved support cavity, wherein the curved support cavity defines an average radius of curvature greater than 5 inches and up to 7.5 inches, and wherein the first free end and the second free end have a length in a range from 7 inches to 8 inches; and a fabric shell enclosing an amount of a fill material;

wherein the fabric shell comprises:

a U-shaped first piece;

a U-shaped second piece;

a gusset connected to the U-shaped first piece and the U-shaped second piece, the gusset having two ends, wherein the gusset extends around the inner periphery and at least part of the outer periphery; and an elongated flap extending from a rear side of the U-shaped first piece, wherein the elongated flap is coupled to the U-shaped second piece and the two ends of the gusset; and wherein the fill material is in contact with the U-shaped first piece, the U-shaped second piece, the gusset, and the elongated flap.

2. The support pillow of claim 1, wherein the U-shaped second piece comprises:

the elongated flap comprising:

a first flap edge sewn to the gusset; and a second flap edge opposite of the first flap edge sewn to the gusset, and wherein the U-shaped first piece is sewn to the U-shaped second piece along a third edge of the elongated flap and the gusset is sewn to the U-shaped first piece, the U-shaped second piece, the first flap edge and the second flap edge.

3. The support pillow of claim 1, wherein the U-shaped second piece comprises:

the elongated flap integral with the rear side of the U-shaped first piece section and comprising:

a first flap edge sewn to the gusset;

a second flap edge opposite of the first flap edge sewn to the gusset, and a third flap edge between the first flap edge and the second flap edge that is sewn to the U-shaped first piece; and a fourth flap edge opposite of the third flap edge and sewn to a portion of the U-shaped second piece.

4. The support pillow of claim 1, wherein the gusset further comprises:

gusset ends each having a first height between 2 inches and 3 inches; and a gusset portion running between the gusset ends having a second height less than the first height and between 1.5 inches and 2 inches.

5. The support pillow of claim 1, wherein the substantially straight medial region comprise a length between 22.5 inches and 24 inches.

6. The support pillow of claim 5, wherein the pillow body comprises a width between 15 inches and 16 inches.

7. The support pillow of claim 1, wherein the fabric shell further comprises:

a front portion joined with the U-shaped first piece; and a back portion joined with the U-shaped first piece and the front portion, wherein the front portion and the back portion enclose the fill material.

8. The support pillow of claim 1, further comprising:

a zipper opening comprising zipper opening ends that are spaced apart between 6 inches and 7 inches; and a zipper between the zipper opening ends and configured to close the zipper opening.

9. The support pillow of claim 8, wherein the zipper is coupled to the elongated flap and the U-shaped first piece at the outer periphery.

10. The support pillow of claim 8, wherein the zipper opening ends comprise at least three backstitches over a seam joining the U-shaped first piece and the U-shaped second piece.

11. The support pillow of claim 8, wherein the zipper opening ends comprise at least one fabric brace on a side of the fabric shell with the fill material and stitched to the U-shaped first piece and the U-shaped second piece.

12. A support pillow comprising:

a pillow body comprising:

a substantially straight medial region;

a substantially straight first arm extending from the substantially straight medial region and having a first free end;

a substantially straight second arm extending from the substantially straight medial region and having a second free end;

wherein the substantially straight first arm, the substantially straight medial region, and the substantially straight second arm define an outer periphery and an inner periphery; and wherein the inner periphery defines a curved support cavity, wherein the curved support cavity defines an average radius of curvature greater than 5 inches and up to 7.5 inches, and wherein the first free end and the second free end have a length in a range from 7 inches to 8 inches; and a fabric shell enclosing an amount of a fill material such that the support pillow has a prescribed firmness where the middle of the substantially straight medial region and the substantially straight arms protrude above a gusset by up to 2.5 inches comprising:

a first piece;

a U-shaped second piece;

the gusset connected to the first piece and the U-shaped second piece, extending around the inner periphery and at least part of the outer periphery and comprising:

a first edge along a first end of the gusset with a first end width between 2 inches and 3 inches and coupled to the first piece;

a second edge along a second end of the gusset with a second end width between 2 inches and 3 inches and coupled to the first piece;

a portion between the first end of the gusset and the second end of the gusset, the portion having a width between 1.5 inches and 3 inches; and a third edge having a length between 50 inches and 56 inches connecting the first edge and the second edge; and wherein the fill material is in contact with the first piece, the U-shaped second piece and the gusset.

13. The support pillow of claim 12, wherein the substantially straight first arm is parallel with respect to the substantially straight second arm.

14. The support pillow of claim 12, wherein the first free end and the second free end are blunt.

15. A support pillow comprising:

a pillow body comprising:

a substantially straight medial region;

a substantially straight first arm extending from the substantially straight medial region between 7 inches and 8 inches, and having a first free end;

a substantially straight second arm extending from the substantially straight medial region between 7 inches and 8 inches, and having a second free end;

wherein a distance between the first free end and the second free end is at least 8 inches;

wherein the substantially straight first arm, the substantially straight medial region, and the substantially straight second arm define an outer periphery and an inner periphery; and wherein the inner periphery defines a curved support cavity, wherein the curved support cavity defines an average radius of curvature greater than 5 inches and up to 7.5 inches; and a fabric shell enclosing an amount of a fill material that provides substantially all of the pillow body with a prescribed firmness where a force of at least 10 Newtons applied over at least seconds is required to displace a 3-inch diameter hemispheric probe 1 inch into the pillow body;

wherein the fabric shell comprises:

a U-shaped first piece;

a U-shaped second piece; and a gusset connected to the U-shaped first piece and the U-shaped second piece, the gusset having two ends, and the gusset extending around the inner periphery and at least part of the outer periphery; and an elongated flap extending from a rear side of the U-shaped first piece, wherein the elongated flap is coupled to the U-shaped second piece and the two ends of the gusset; and wherein the fill material is in contact with the U-shaped first piece, the U-shaped second piece, the gusset, and the elongated flap.

* * * * *